US010931045B2

(12) United States Patent
Aoki et al.

(10) Patent No.: US 10,931,045 B2
(45) Date of Patent: Feb. 23, 2021

(54) CONNECTOR

(71) Applicant: JAPAN AVIATION ELECTRONICS INDUSTRY, LIMITED, Tokyo (JP)

(72) Inventors: Shigeharu Aoki, Tokyo (JP); Akira Kimura, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 16/592,646

(22) Filed: Oct. 3, 2019

(65) Prior Publication Data

US 2020/0112113 A1 Apr. 9, 2020

(30) Foreign Application Priority Data

Oct. 4, 2018 (JP) ..... JP2018-188910

(51) Int. Cl.
*H01R 13/64* (2006.01)
*H01R 12/71* (2011.01)
(Continued)

(52) U.S. Cl.
CPC ..... *H01R 12/716* (2013.01); *H01R 12/737* (2013.01); *H01R 13/24* (2013.01);
(Continued)

(58) Field of Classification Search
CPC .... H01R 12/716; H01R 12/737; H01R 13/24; H01R 13/41; H01R 13/6315; H01R 24/60; H01R 2107/00; H01R 12/91
(Continued)

(56) References Cited

U.S. PATENT DOCUMENTS 9,484,656 B2 11/2016 Doi et al.
10,290,975 B2 5/2019 Takane
(Continued)

FOREIGN PATENT DOCUMENTS

CN 2899160 Y 5/2007
CN 107078426 A 8/2017
(Continued)

OTHER PUBLICATIONS

Extended European Search Report (EESR) dated Feb. 5, 2020, issued in European Application No. 19200684.9.
(Continued)

*Primary Examiner* — Abdullah A Riyami
*Assistant Examiner* — Nelson R. Burgos-Guntin
(74) *Attorney, Agent, or Firm* — Holtz, Holtz & Volek PC

(57) ABSTRACT

A connector comprises a fixed housing and a movable housing movable relative to the fixed housing. The fixed housing has an end wall, and the movable housing has a regulated portion. The end wall is provided with a stopping portion and a projecting portion projecting inward in a pitch direction (Y-direction). The regulated portion is provided with a reference surface, a stopped portion and a receiving recess. The stopped portion projects outward in the pitch direction beyond the reference surface to be located below the stopping portion, and an upward movement thereof is regulated by the stopping portion. The receiving recess is recessed inward in the pitch direction beyond the reference surface. The receiving recess faces, at least in part, the projecting portion in the pitch direction or receives, at least in part, the projecting portion.

8 Claims, 14 Drawing Sheets

(51) Int. Cl.

| | |
|---|---|
| ***H01R 12/73*** | (2011.01) |
| ***H01R 13/24*** | (2006.01) |
| ***H01R 13/41*** | (2006.01) |
| ***H01R 13/631*** | (2006.01) |
| ***H01R 24/60*** | (2011.01) |
| *H01R 107/00* | (2006.01) |

(52) U.S. Cl.
CPC ..... *H01R 13/41* (2013.01); *H01R 13/6315* (2013.01); *H01R 24/60* (2013.01); *H01R 2107/00* (2013.01)

(58) Field of Classification Search
USPC ..... 439/74
See application file for complete search history.

(56) References Cited

U.S. PATENT DOCUMENTS

| | | | | |
|---|---|---|---|---|
| 2007/0202729 | A1* | 8/2007 | Uesaka | H01R 12/707 439/248 |
| 2012/0003875 | A1 | 1/2012 | Akai et al. | |
| 2016/0204536 | A1 | 7/2016 | Doi et al. | |
| 2016/0294111 | A1* | 10/2016 | Kobayashi | H01R 12/716 |
| 2017/0338592 | A1* | 11/2017 | Doi | H01R 12/7035 |
| 2018/0048083 | A1* | 2/2018 | Doi | H01R 12/716 |
| 2018/0145436 | A1* | 5/2018 | Doi | H01R 12/716 |
| 2018/0145467 | A1* | 5/2018 | Doi | H01R 24/60 |
| 2019/0013608 | A1* | 1/2019 | Yoshida | H01R 13/6315 |
| 2020/0112113 | A1* | 4/2020 | Aoki | H01R 12/91 |
| 2020/0127417 | A1* | 4/2020 | Shimba | H01R 13/5025 |

FOREIGN PATENT DOCUMENTS

| | | | |
|---|---|---|---|
| CN | 108306131 | A | 7/2018 |
| JP | 2015035352 | A | 2/2015 |
| JP | 6170593 | B1 | 7/2017 |
| JP | 2017120696 | A | 7/2017 |
| TW | M472992 | U | 2/2014 |
| WO | 2004062041 | A1 | 7/2004 |

OTHER PUBLICATIONS

Taiwanese Office Action (and English language translation thereof) dated May 12, 2020 issued in Taiwanese Application No. 108134351.
Chinese Office Action (and English language translation thereof) dated Sep. 15, 2020 issued in Chinese Application No. 201910902562.8.

* cited by examiner

CONNECTOR

CROSS REFERENCE TO RELATED APPLICATIONS

This application is based on and claims priority under 35 U.S.C. § 119 to Japanese Patent Application No. JP2018-188910 filed Oct. 4, 2018, the content of which is incorporated herein in its entirety by reference.

BACKGROUND OF THE INVENTION

This invention relates to a floating connector comprising a fixed housing and a movable housing which is movable relative to the fixed housing.

For example, such a floating connector is disclosed in JP2015-35352A (Patent Document 1), the content of which is incorporated herein by reference.

Referring to FIGS. 25 and 26, Patent Document 1 discloses a connector 90 comprising a fixed housing 92, a movable housing 94 and a plurality of terminals 96. The terminals 96 are held both by the fixed housing 92 and by the movable housing 94, and are arranged in a pitch direction. The movable housing 94 is supported by the terminals 96 to be movable relative to the fixed housing 92. Thus, the connector 90 is a floating connector.

Referring to FIG. 26, the fixed housing 92 is formed with a fixed-side opening (accommodation portion) 922. The movable housing 94 has two engagement blocks (stopped portions) 944 and a movable body portion (fit portion) 942 which is to be fit to a mating connector (not shown). The fit portion 942 is inserted into the accommodation portion 922 from below. Each of the stopped portions 944 projects outward in the pitch direction from a lower end of the fit portion 942. Referring to FIGS. 25 and 26, when the movable housing 94 is moved upward relative to the fixed housing 92, the stopped portions 944 are brought into abutment with and stopped by opposite end parts of the fixed housing 92 in the pitch direction, respectively, so that the movable housing 94 is prevented from coming off upward.

In general, a fit portion of a movable housing has a predetermined size in a pitch direction which is determined depending on the number of terminals arranged in the pitch direction, and the size of the fit portion in the pitch direction cannot be made smaller than the predetermined size. In particular, since the structure disclosed in Patent Document 1 requires the stopped portions each of which projects outward in the pitch direction, the size of the entire movable housing in the pitch direction is larger than the size of the fit portion in the pitch direction. The size of the fixed housing in the pitch direction is required to be larger than the size of the entire movable housing in the pitch direction. Thus, according to an existing structure such as that of Patent Document 1, a floating connector tends to have a large size in the pitch direction as a whole.

SUMMARY OF THE INVENTION

It is therefore an object of the present invention to provide a floating connector with a structure which enables the floating connector to be reduced in size in the pitch direction.

An aspect of the present invention provides a connector mateable with a mating connector which comprises a mating fit portion. The connector comprises a fixed housing, a movable housing and a plurality of terminals. The terminals are held by the fixed housing and are arranged in a pitch direction. The fixed housing has two sidewalls, two end walls and an accommodation portion. Each of the sidewalls extends along the pitch direction. Each of the end walls couples the sidewalls with each other in a width direction perpendicular to the pitch direction. The accommodation portion is a space which is enclosed by the sidewalls and the end walls in a horizontal plane defined by the pitch direction and the width direction. Each of the end walls has a stopping portion and a projecting portion. Each of the stopping portions faces downward in an upper-lower direction perpendicular to both the pitch direction and the width direction. Each of the projecting portions projects inward in the pitch direction. The movable housing is movable relative to the fixed housing along the upper-lower direction and is movable relative to the fixed housing along the horizontal plane. The movable housing has a fit portion and a base portion. The fit portion is fit to the mating fit portion under a mated state where the connector and the mating connector are mated with each other. The base portion is located below the fit portion and is, at least in part, accommodated in the accommodation portion. The base portion has two regulated portions which correspond to the end walls, respectively. The regulated portions are located at opposite ends of the base portion in the pitch direction, respectively. Each of the regulated portions has a reference surface, a stopped portion and a receiving recess. In each of the regulated portions, the reference surface is located at a position that is outermost in the pitch direction except the stopped portion. Each of the stopped portions projects outward in the pitch direction beyond the reference surface and is located below a corresponding one of the stopping portions, and an upward movement thereof is regulated by the corresponding one of the stopping portions. Each of the receiving recesses is recessed inward in the pitch direction beyond the reference surface. Each of the receiving recesses faces, at least in part, a corresponding one of the projecting portions in the pitch direction or receives, at least in part, the corresponding one of the projecting portions.

According to the connector of an aspect of the present invention, the movable housing is movable relative to the fixed housing. In other words, the connector according to an aspect of the present invention is a floating connector. According to an aspect of the present invention, the stopped portion of the movable housing is located below the stopping portion of the fixed housing. An upward movement of the movable housing is regulated by the stopped portion and the stopping portion which are arranged as described above, so that the movable housing is prevented from coming off above the fixed housing.

According to an aspect of the present invention, the regulated portion is an end part of the base portion in the pitch direction. In the-thus located regulated portion, the reference surface is located at the position that is outermost in the pitch direction except the stopped portion. The receiving recess is recessed inward of the reference surface in the pitch direction. According to this structure, the receiving recess can be designed to receive the projecting portion of the fixed housing upon a movement of the movable housing, and this design enables the fixed housing to be reduced in size in the pitch direction without reducing a movable range of the movable housing in the pitch direction. Moreover, according to an aspect of the present invention, the stopped portion projects outward beyond the reference surface in the pitch direction. This structure enables the stopped portion to be reduced in size in the pitch direction while the stopped portion sufficiently projects outward in the pitch direction relative to an inside wall surface of the receiving recess in the pitch direction. Thus, a size of the entire movable housing including the stopped portion can be reduced in the pitch direction. As a result, the connector can be reduced in size in the pitch direction while the movable housing is prevented from coming off above the fixed housing.

As described above, according to an aspect of the present invention, the connector can be reduced in size in the pitch direction as a whole. Meanwhile, the movable housing has a sufficient movable range in the pitch direction, and the movable housing is prevented from coming off above the fixed housing. Thus, an aspect of the present invention provides a floating connector with a structure which enables the floating connector to be reduced in size in the pitch direction.

An appreciation of the objectives of the present invention and a more complete understanding of its structure may be had by studying the following description of the preferred embodiment and by referring to the accompanying drawings.

Figure 1:
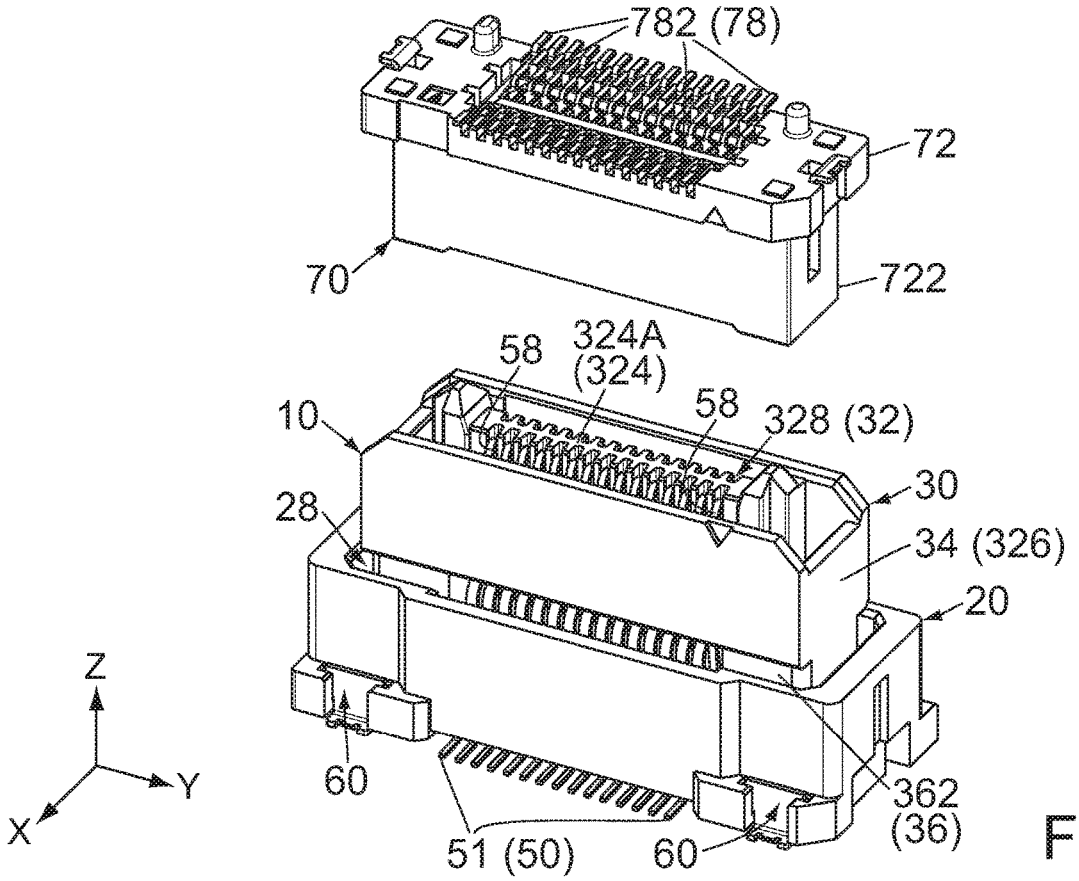
FIG. 1 is a perspective view showing a connector and a mating connector according to an embodiment of the present invention, wherein the connector and the mating connector are separated from each other.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Referring to FIGS. 1 to 4, a connector 10 according to an embodiment of the present invention is mateable with a mating connector 70 along an upper-lower direction (Z-direction). The mating connector 70 mated with the connector 10 is removable from the connector 10 along the Z-direction.

Figure 3:
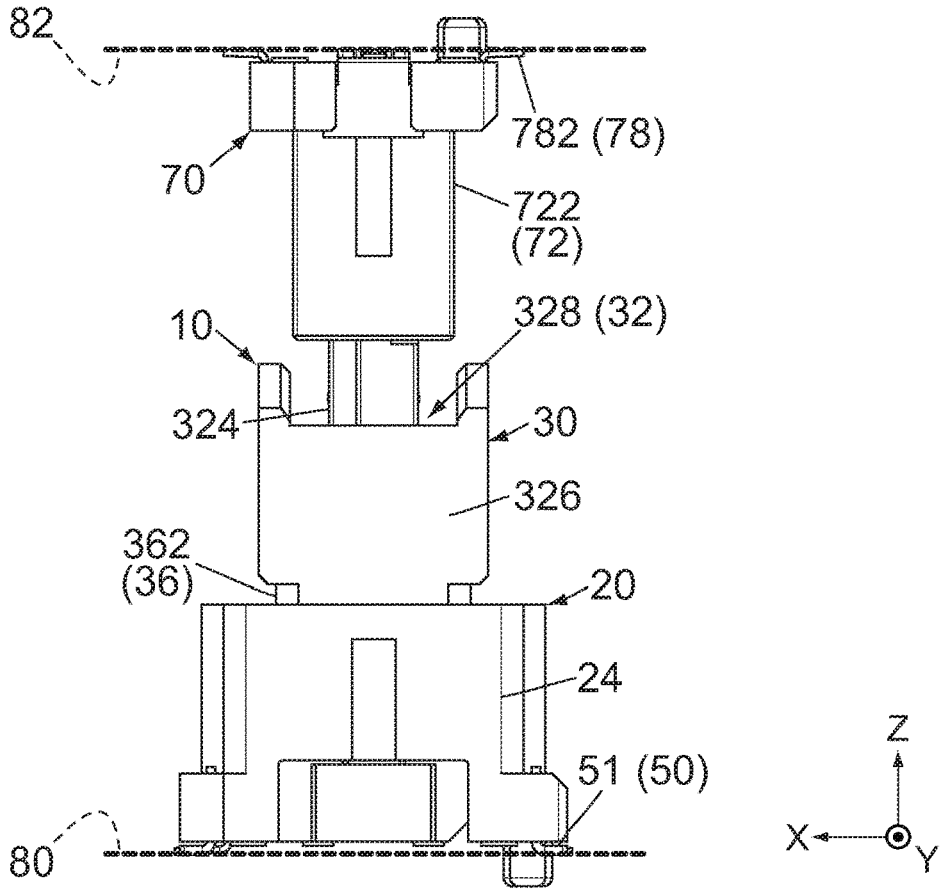
FIG. 3 is a side view showing the connector and the mating connector of FIG. 1, wherein the connector is in a mating process with the mating connector, and a part of a circuit board, on which the connector is mounted, and a part of a mating circuit board, on which the mating connector is mounted, are illustrated with dashed line.
Figure 4:
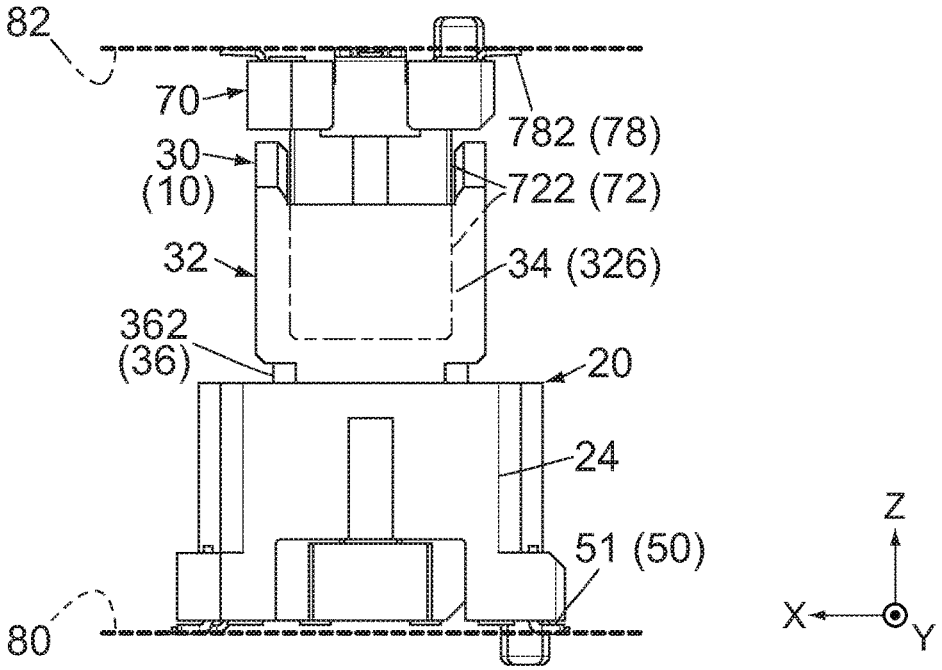
FIG. 4 is a side view showing the connector and the mating connector of FIG. 2, wherein a part of the circuit board and a part of the mating circuit board are illustrated with dashed line, and an outline of a part of a mating fit portion of the mating connector, which is inserted in the connector, is illustrated with chain dotted lines.

Referring to FIGS. 3 and 4, in the present embodiment, the connector 10 is an on-board connector which is to be mounted on a circuit board 80, and the mating connector 70 is another on-board connector which is to be mounted on a mating circuit board 82. Moreover, the connector 10 is a plug, and the mating connector 70 is a receptacle. However, the present invention is not limited thereto but is applicable to various connectors. For example, the connector 10 may be a receptacle, and the mating connector 70 may be a plug.

Referring to FIGS. 1 to 4, the mating connector 70 comprises a mating fit portion 722 which is to be fit to the connector 10. In detail, the mating connector 70 comprises a mating housing 72 made of insulator and a plurality of mating terminals 78 each made of conductor. The mating fit portion 722 is a lower part, or the negative Z-side part, of the mating housing 72. The mating fit portion 722 has a mating receiving portion (not shown) formed therewithin. The mating receiving portion opens downward, or in the negative Z-direction.

The mating terminals 78 have shapes same as one another and are grouped into two rows in a width direction (X-direction) perpendicular to the Z-direction. The mating terminals 78 of each row are held by the mating housing 72 and are arranged at regular intervals in a pitch direction (Y-direction) perpendicular to both the X-direction and the Z-direction. Each of the mating terminals 78 has a mating fixed portion 782 and a mating contact portion (not shown). Each of the mating fixed portions 782 extends outward in the X-direction from an upper end, or the positive Z-side end, of the mating housing 72. When the mating connector 70 is used, each of the mating fixed portions 782 is fixed on and connected to a conductive pad (not shown) of the mating circuit board 82 via soldering, etc. Each of the mating contact portions is arranged in the mating receiving portion (not shown).

The mating connector 70 of the present embodiment has the aforementioned structure. However, the structure of the mating connector 70 can be variously modified in accordance with the structure of the connector 10.

Referring to FIGS. 1, 5, 6 and 16, the connector 10 of the present embodiment comprises a fixed housing 20 made of insulator, a movable housing 30 made of insulator, a plurality of terminals 50 each made of conductor and four strengthening members 60 each made of metal. The strengthening members 60 are attached to four corners of the fixed housing 20 in a horizontal plane (XY-plane) defined by the X-direction and the Y-direction, respectively, and strengthen the fixed housing 20. However, the present invention is not limited to the present embodiment. For example, the strengthening members 60 may be provided as necessary. Moreover, the connector 10 may further comprise a member other than the strengthening member 60 in addition to the fixed housing 20, the movable housing 30 and the terminals 50.

Figure 16:
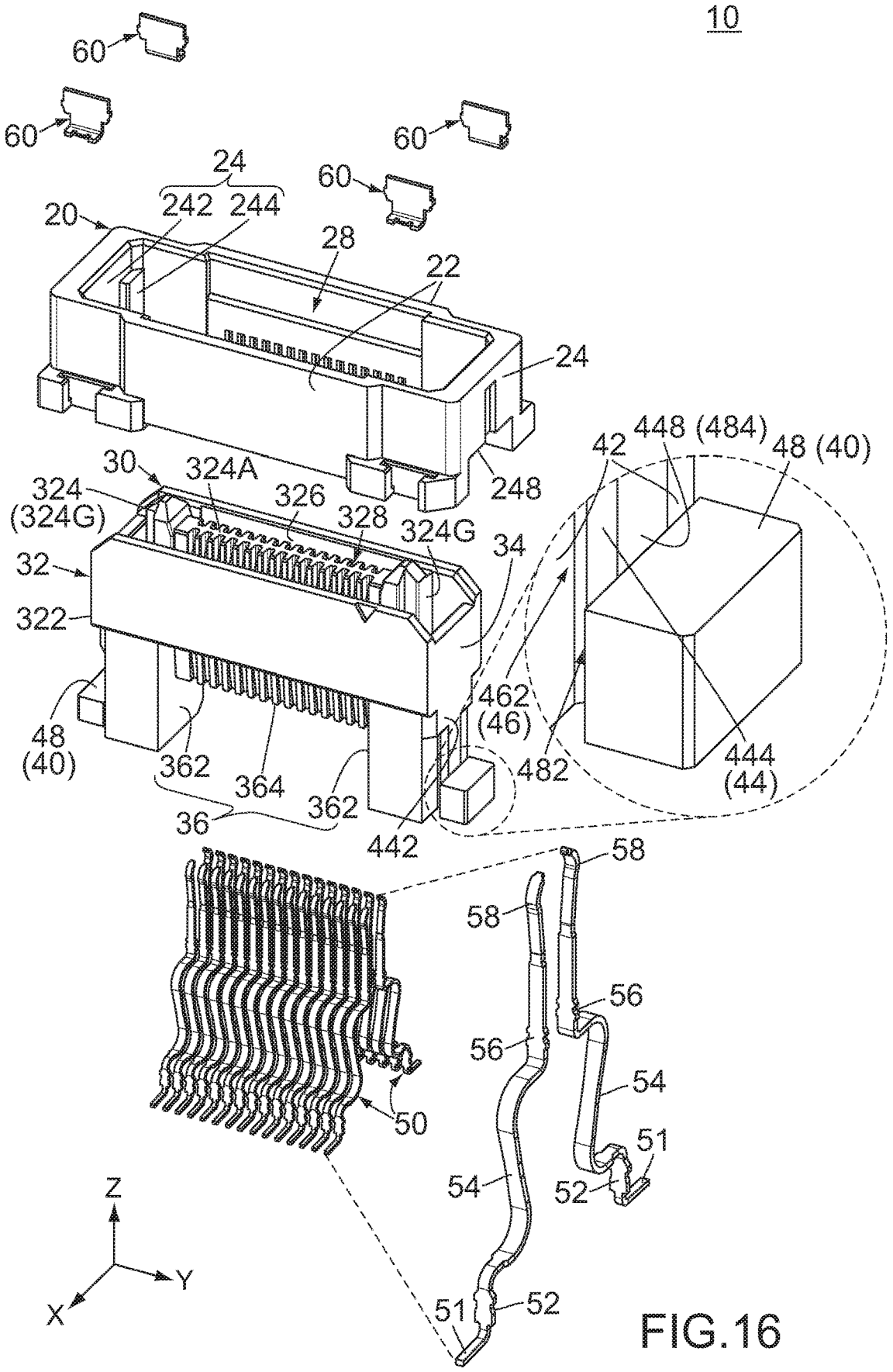
FIG. 16 is an exploded, perspective view showing the connector of FIG. 1, wherein a part of the movable housing enclosed by dashed line is enlarged to be illustrated, and two of terminals are enlarged to be illustrated.
Figure 17:
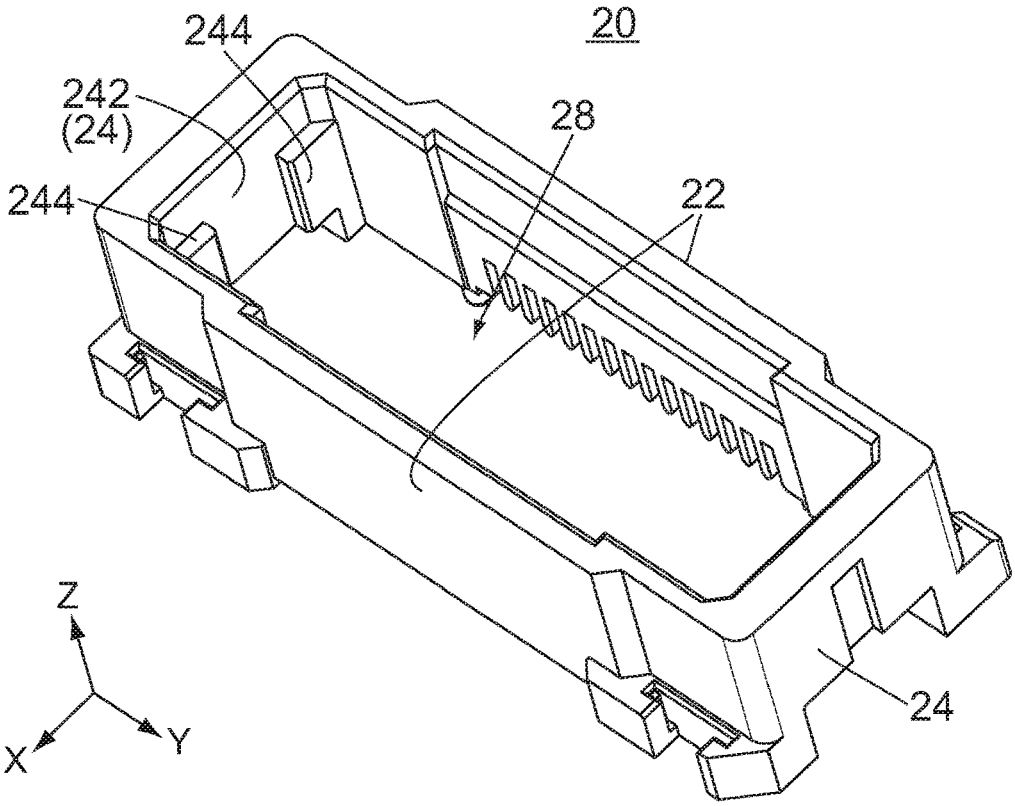
FIG. 17 is a perspective view showing the fixed housing of the connector of FIG. 16.
Figure 18:
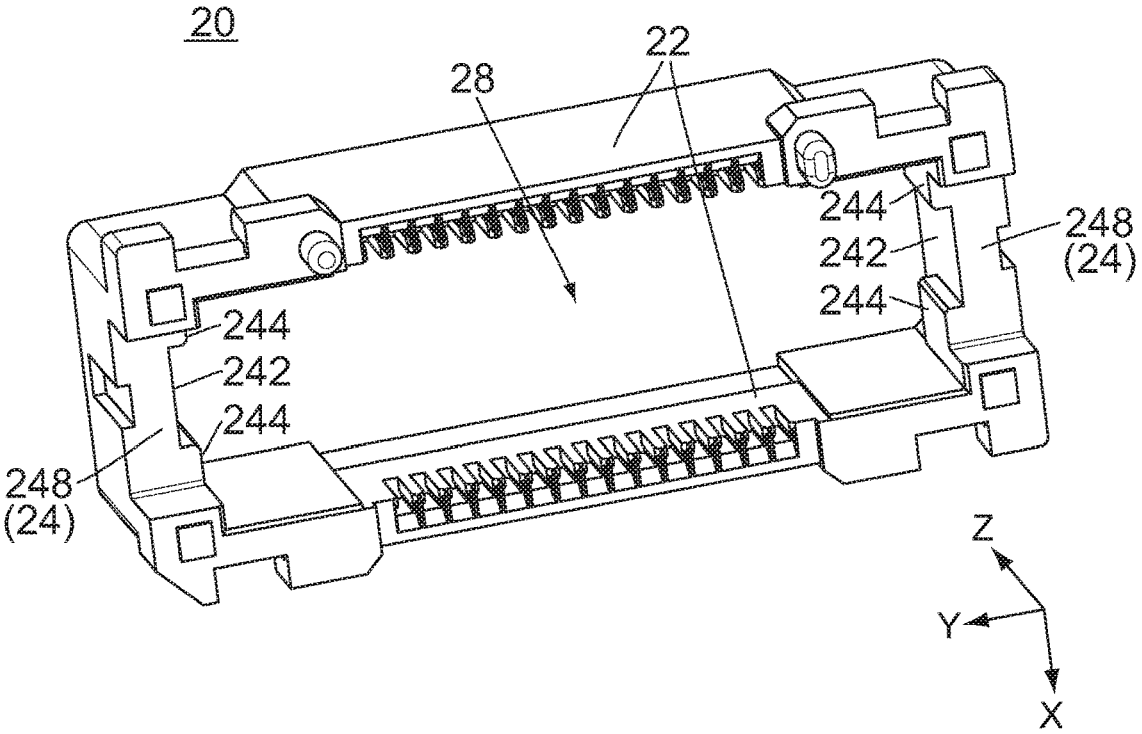
FIG. 18 is another perspective view showing the fixed housing of FIG. 17.
Figure 19:
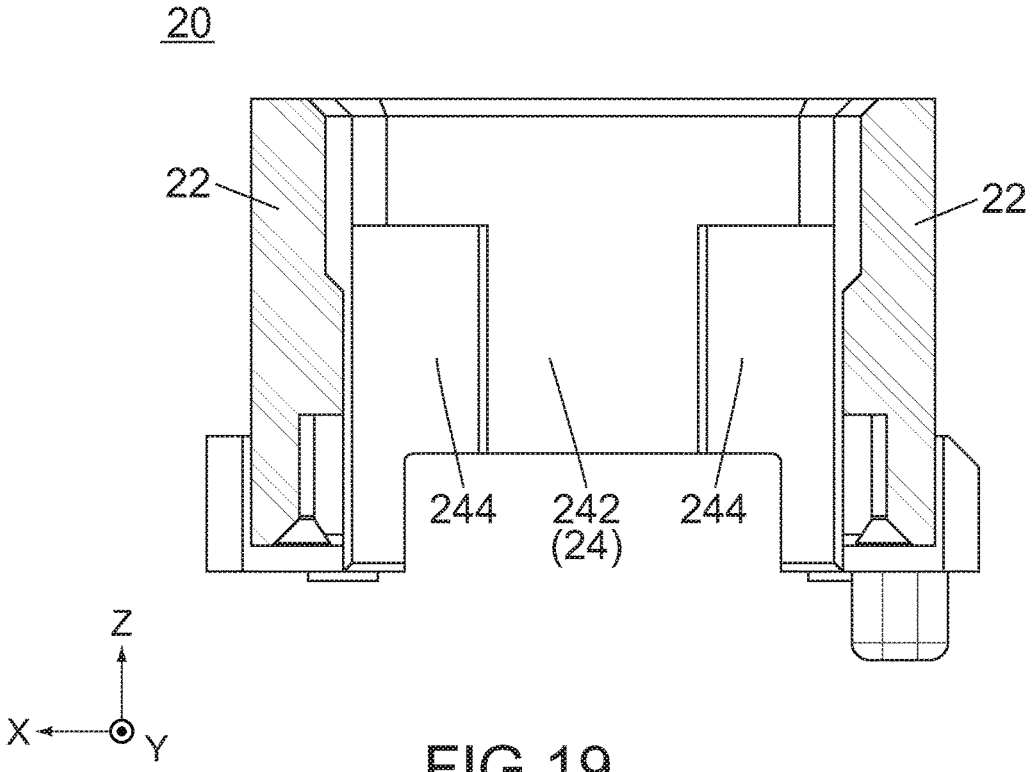
FIG. 19 is a cross-sectional view showing the fixed housing of the connector of FIG. 6, taken along line XIX-XIX.

As shown in FIGS. 16 to 18, the fixed housing 20 has two sidewalls 22, two end walls 24 and an accommodation portion 28. Each of the sidewalls 22 extends along the Y-direction. Each of the end walls 24 extends along the X-direction and couples the two sidewalls 22 with each other in the X-direction. The accommodation portion 28 is a space which is enclosed by the sidewalls 22 and the end walls 24 in the XY-plane. The accommodation portion 28 opens downward and opens upward, or in the positive Z-direction.

Referring to FIGS. 16 to 19, each of the end walls 24 according to the present embodiment has a plate portion 242, two projecting portions 244 and a stopping portion 248. Each of the plate portions 242 has a flat plate shape in parallel to the XZ-plane. In each of the end walls 24, the two projecting portions 244 are provided on opposite sides of the plate portion 242 in the X-direction, respectively. Each of the projecting portions 244 projects inward in the Y-direction. In detail, each of the projecting portions 244 has a flat plate shape in parallel to the XZ-plane and protrudes into the accommodation portion 28 from the plate portion 242. Each of the stopping portions 248 is a lower surface, or the negative Z-side surface, of the end wall 24. Each of the stopping portions 248 is a plane in parallel to the XY-plane and faces downward in the Z-direction.

Each of the end walls 24 according to the present embodiment has the aforementioned structure. However, the structure of the end wall 24 according to the present invention is not limited to the present embodiment, provided that each of the end walls 24 is provided with one or more of the projecting portions 244 each projecting inward in the Y-direction and one or more of the stopping portions 248 each facing downward. For example, each of the stopping portions 248 is not limited to the lower surface of the end wall 24.

Figure 2:
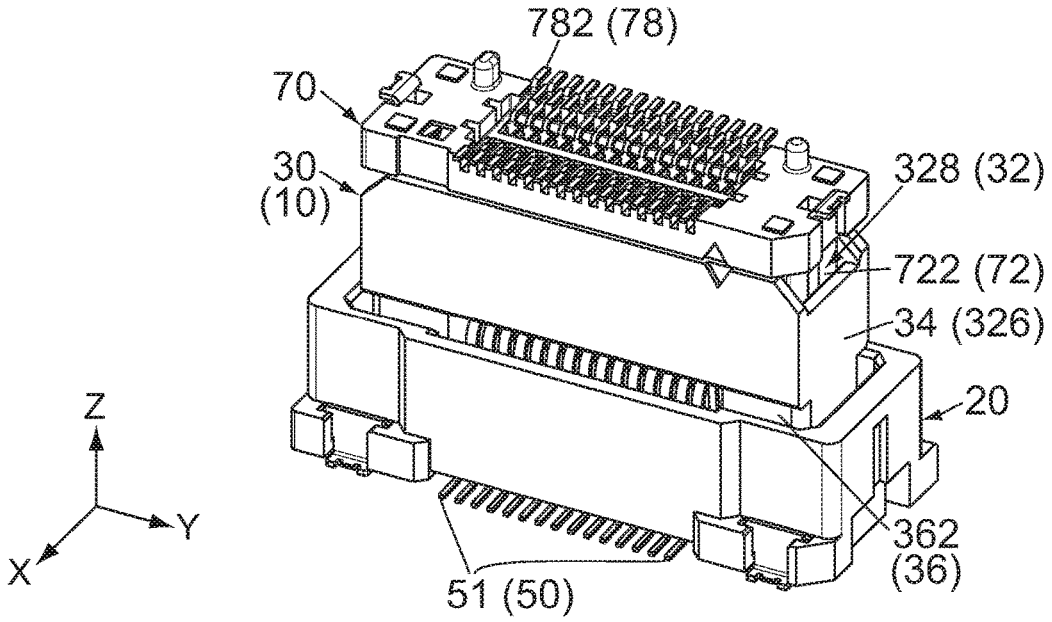
FIG. 2 is a perspective view showing the connector and the mating connector of FIG. 1, wherein the connector and the mating connector are mated with each other.

As shown in FIGS. 16 and 20 to 24, the movable housing 30 has a fit portion 32 and a base portion 36. Referring to FIGS. 1 and 2, the fit portion 32 is an upper part, or the positive Z-side part, of the movable housing 30 and is to be mated with the mating connector 70. In detail, the fit portion 32 is fit to the mating fit portion 722 under a mated state where the connector 10 and the mating connector 70 are mated with each other. The base portion 36 is located below the fit portion 32 and is located below the mating connector 70 under the mated state.

Figure 20:
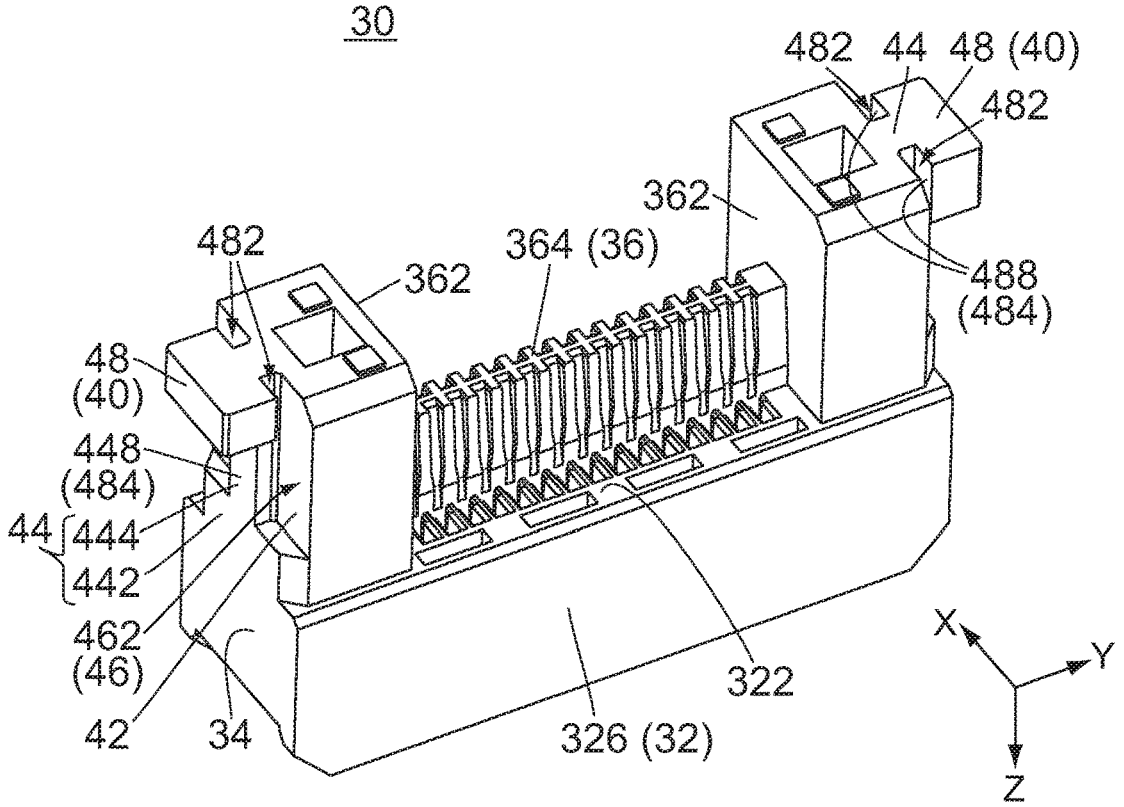
FIG. 20 is a perspective view showing the movable housing of the connector of FIG. 16.
Figure 21:
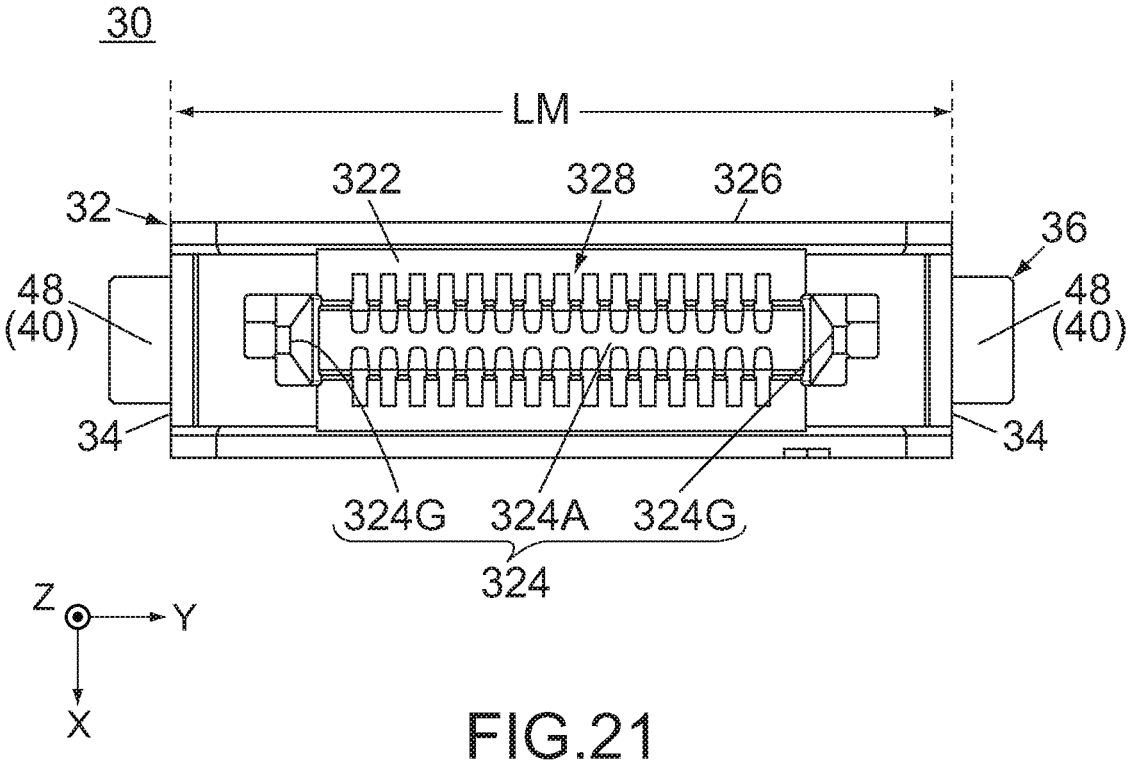
FIG. 21 is a top view showing the movable housing of FIG. 20.
Figure 23:
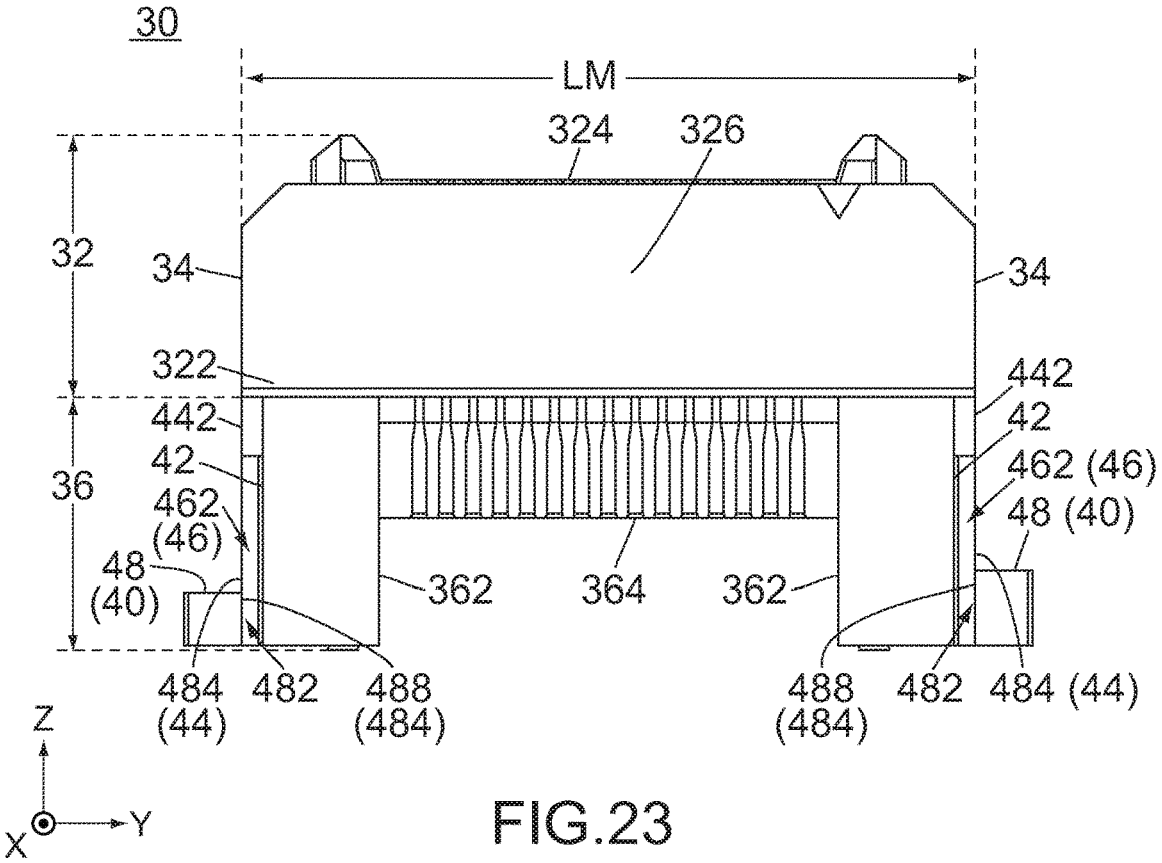
FIG. 23 is a side view showing the movable housing of FIG. 20.
Figure 24:
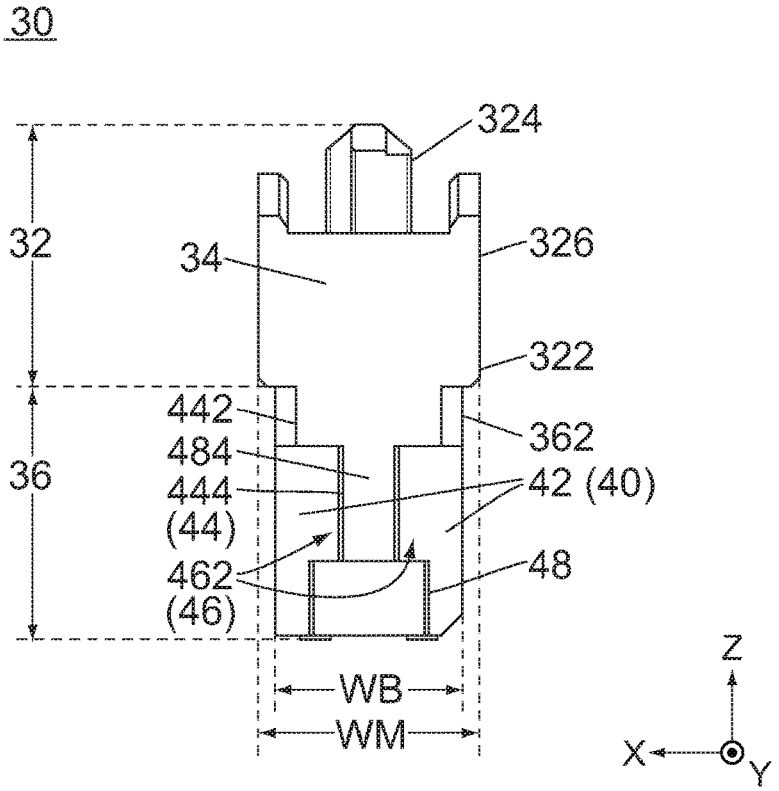
FIG. 24 is another side view showing the movable housing of FIG. 20.
Figure 25:
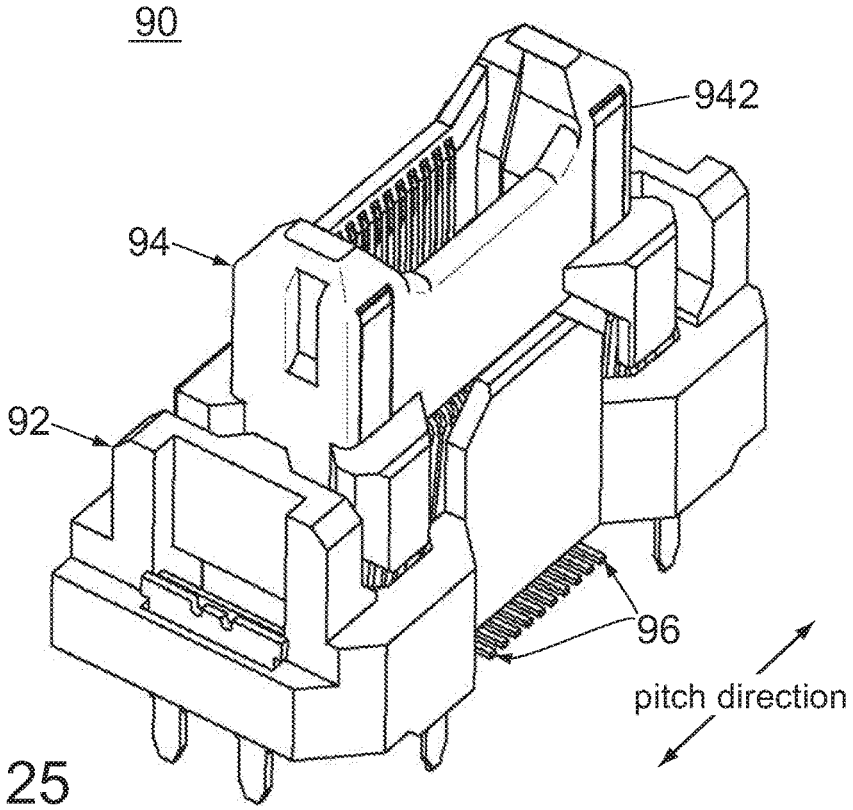
FIG.25 PRIOR ART
FIG. 25 is a perspective view showing the connector of Patent Document 1.
Figure 26:
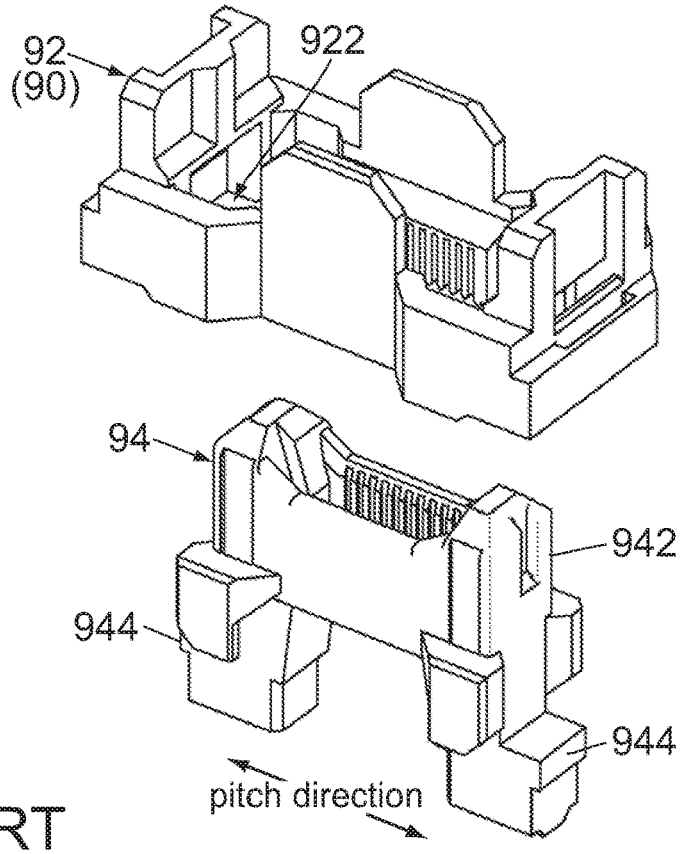
FIG.26 PRIOR ART
FIG. 26 is an exploded, perspective view showing a fixed housing and a movable housing of the connector of FIG. 25.

Referring to FIGS. 16, 23 and 24, the fit portion 32 according to the present embodiment has a bottom portion 322, an island-like portion 324, a peripheral wall 326 and a receiving portion 328. Referring to FIG. 20, the bottom portion 322 is located at a lower end, or the negative Z-side end, of the fit portion 32. Referring to FIGS. 16 and 21, the island-like portion 324 projects upward from a middle part of the bottom portion 322 in the XY-plane and extends long along the Y-direction. The island-like portion 324 is provided with an arrangement portion 324A, on which the terminals 50 are arranged in the Y-direction, and two guide portions 324G which are located at opposite ends of the arrangement portion 324A in the Y-direction, respectively. The peripheral wall 326 extends upward from the bottom portion 322 while enclosing the island-like portion 324 in the XY-plane. The receiving portion 328 is a space which is enclosed by the peripheral wall 326 in the XY-plane. The receiving portion 328 encloses the island-like portion 324 in the XY-plane.

Referring to FIGS. 1 and 2, the receiving portion 328 according to the present embodiment opens upward under a separated state where the connector 10 and the mating connector 70 are separated from each other, or under the state shown in FIG. 1, and receives the mating fit portion 722 of the mating connector 70 under the mated state. Under the mated state, the mating fit portion 722 is received in the space between the peripheral wall 326 and the island-like portion 324, and the island-like portion 324 is received in the mating receiving portion (not shown). Under this mated state, the terminals 50 are brought into contact with the mating terminals 78, respectively.

As shown in FIGS. 16, 21 and 23, the fit portion 32 has two end surfaces 34. The end surfaces 34 are located at opposite ends of the fit portion 32 in the Y-direction, respectively. The end surfaces 34 of the present embodiment are parts of predetermined surfaces of the peripheral wall 326 which are located at opposite ends of the peripheral wall 326 in the Y-direction. In detail, referring to FIG. 4, each of the end surfaces 34 is a part of the predetermined surface of the peripheral wall 326 that is located above a lower end of the mating fit portion 722 under the mated state. Referring to FIG. 23, a distance dimension LM between the two end surfaces 34 in the Y-direction is equal to a size of the fit portion 32 in the Y-direction. Referring to FIG. 21, the distance dimension LM is determined depending on the number of the terminals 50 arranged in the Y-direction, and the size of the fit portion 32 in the Y-direction cannot be made smaller than the distance dimension LM.

The fit portion 32 according to the present embodiment has the aforementioned structure. However, the present invention is not limited thereto, but the structure of the fit portion 32 can be variously modified. For example, referring to FIGS. 1 and 2, the fit portion 32 may be entirely received in the mating receiving portion of the mating fit portion 722 under the mated state. According to this structure, the fit portion 32 does not need to have the peripheral wall 326. Instead, the fit portion 32 may have the peripheral wall 326 while no island-like portion 324 is provided. According to this structure, the mating contact portions (not shown) of the mating terminals 78 may be exposed on side surfaces of the mating fit portion 722. Moreover, the end surfaces 34 may be parts of some portion other than the peripheral wall 326, provided that the end surfaces 34 are located above the lower end of the mating fit portion 722 under the mated state.

Referring to FIGS. 16, 20, 22 and 23, the base portion 36 according to the present embodiment extends downward from the lower end of the fit portion 32 and has two columnar portions 362 and a coupling portion 364. The columnar portions 362 extend downward from opposite end parts of the bottom portion 322 in the Y-direction, respectively. The coupling portion 364 extends downward from a middle part of the bottom portion 322 in the Y-direction. The coupling portion 364 extends along the Y-direction and couples the two columnar portions 362 to each other in the Y-direction.

Referring to FIG. 16, the base portion 36 has two regulated portions 40 which correspond to the two end walls 24 of the fixed housing 20, respectively. The regulated portions 40 are located at opposite ends of the base portion 36 in the Y-direction, respectively. The regulated portions 40 of the present embodiment are provided so as to correspond to the two columnar portions 362, respectively. More specifically, referring to FIGS. 16, 20, 22 and 23, each of the columnar portions 362 has a boundary surface 42. Each of the boundary surfaces 42 is a plane in parallel to the XZ-plane and is located at an outer end of the columnar portion 362 in the Y-direction. Each of the regulated portions 40 includes the boundary surface 42 of the corresponding columnar portion 362. In addition, each of the regulated portions 40 has a protruding portion 44, a receiving recess 46, a stopped portion 48 and a reference surface 484 each of which is located outward of the boundary surface 42 in the Y-direction. Thus, each of the boundary surfaces 42 defines the inside boundary of the regulated portion 40 in the Y-direction.

The base portion 36 according to the present embodiment has the aforementioned structure. However, the structure of the base portion 36 according to the present invention is not limited to the present embodiment, provided that the opposite ends of the base portion 36 in the Y-direction are provided with the two regulated portions 40, respectively. Hereafter, explanation will be made about the structure of one of the regulated portions 40 of the present embodiment. The following explanation about the one of the regulated portions 40 is similarly applicable to each of the regulated portions 40.

Referring to FIGS. 16 and 20, the protruding portion 44 protrudes outward in the Y-direction from the boundary surface 42. The protruding portion 44 has an upper protruding portion 442 and a middle protruding portion 444. Moreover, the protruding portion 44 is formed with an outer surface 448. The upper protruding portion 442 is an upper end part of the protruding portion 44 and extends all over the columnar portion 362 in the X-direction. The middle protruding portion 444 is located at a middle part of the columnar portion 362 in the X-direction. The middle protruding portion 444 linearly extends from a lower end of the upper protruding portion 442 to a lower end of the columnar portion 362 in the Z-direction while having a constant size in the X-direction. The outer surface 448 is an outer surface of the protruding portion 44 in the Y-direction. The outer surface 448 is a plane in parallel to the XZ-plane and defines an outer end of the upper protruding portion 442 and an outer end of the middle protruding portion 444 in the Y-direction.

Referring to FIG. 20, the stopped portion 48 has a flat plate shape in parallel to the XY-plane and protrudes outward in the Y-direction from a lower end part of the middle protruding portion 444. In the X-direction, the stopped portion 48 has a size larger than that of the middle protruding portion 444. In detail, the stopped portion 48 protrudes from opposite sides of the middle protruding portion 444 in the X-direction so that the stopped portion 48 is formed with two inner surfaces 488. Each of the inner surfaces 488 is a plane in parallel to the XZ-plane and faces inward in the Y-direction. Each of the inner surfaces 488 is located at a position same as that of the outer surface 448 of the protruding portion 44 in the Y-direction. The inner surfaces 488 form the reference surface 484 together with the outer surface 448. Thus, the reference surface 484 is a plane in parallel to the XZ-plane and includes the inner surfaces 488 of the stopped portion 48 and the outer surface 448 of the protruding portion 44.

Referring to FIGS. 16 and 20, the receiving recess 46 is a recessed portion which is recessed inward in the Y-direction from the outer surface 448 of the protruding portion 44 to the boundary surface 42. Thus, the boundary surface 42 includes an inner wall surface which is located at the innermost of the receiving recess 46 in the Y-direction. Referring to FIG. 24, the receiving recess 46 includes two recesses 462 arranged in the X-direction. The two recesses 462 are apart from each other in the X-direction. More specifically, the two recesses 462 are arranged across the middle protruding portion 444 in the X-direction. Each of the recesses 462 is located between an upper end of the stopped portion 48 and the lower end of the upper protruding portion 442 in the Z-direction. In other words, the stopped portion 48 is located below the receiving recess 46.

Figure 22:
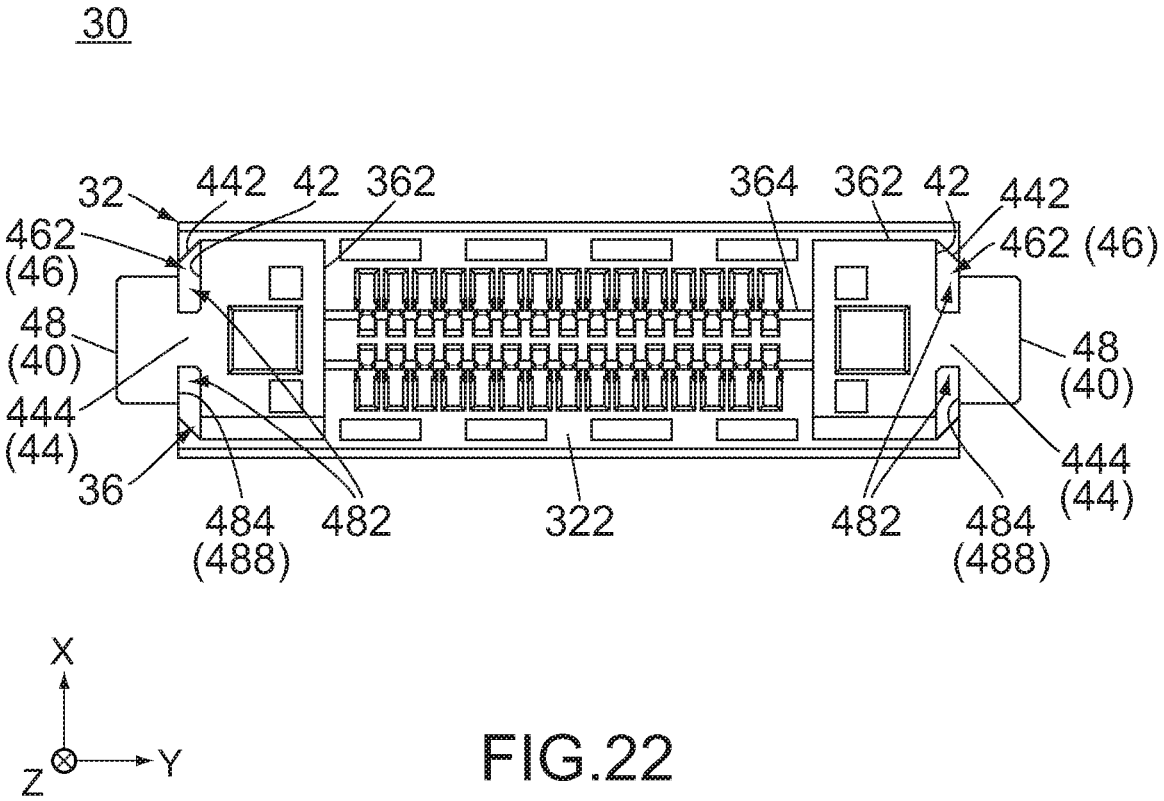
FIG. 22 is a bottom view showing the movable housing of FIG. 20.

Referring to FIGS. 20, 22 and 23, the regulated portion 40 is formed with two communication portions 482 in addition to the aforementioned portions. Each of the communication portions 482 is a space which is located between the inner surface 488 of the stopped portion 48 and the boundary surface 42 in the Y-direction. In other words, each of the communication portions 482 is located inward of the stopped portion 48 in the Y-direction. Each of the communication portions 482 linearly extends along the Z-direction to open upward and downward while having a constant size in the X-direction. Thus, each of the communication portions 482 extends between the receiving recess 46 and a lower end of the stopped portion 48 in the Z-direction.

Each of the regulated portions 40 of the present embodiment has the aforementioned structure. Moreover, the regulated portions 40 of the present embodiment, excluding the stopped portions 48, are arranged to be mirror images of each other with respect to the XZ-plane. The two stopped portions 48 have sizes different from each other in the Z-direction. However, the structure of each of the regulated portions 40 is not limited to the present embodiment. For example, the two stopped portions 48 may have sizes same as each other in the Z-direction. Moreover, the structure of each of the regulated portions 40 can be variously modified as described later, provided that each of the regulated portions 40 is provided with the reference surface 484, the stopped portion 48 which is located outward of the reference surface 484 in the Y-direction and the receiving recess 46 which is located inward of the reference surface 484 in the Y-direction.

Referring to FIG. 16, the terminals 50 of the present embodiment have shapes same as one another and are grouped into two rows in the X-direction. The two rows of the terminals 50 are arranged to be mirror images of each other with respect to the YZ-plane. The terminals 50 of each row are arranged at regular intervals in the Y-direction.

Each of the terminals 50 of the present embodiment is a single metal plate with bends and has a fixed portion 51, a first held portion 52, a spring portion 54, a second held portion 56 and a contact portion 58. The fixed portion 51 extends along the X-direction. The first held portion 52 extends upward from an inner end of the fixed portion 51 in the X-direction. The spring portion 54 extends upward from an upper end of the first held portion 52 while curving. The thus-formed spring portion 54 is resiliently deformable. The second held portion 56 extends upward from an upper end of the spring portion 54. The contact portion 58 extends upward from an upper end of the second held portion 56. Each of the terminals 50 of the present embodiment has the aforementioned structure. However, the structure of the terminal 50 according to the present invention is not limited to the present embodiment but can be variously modified as necessary.

Referring to FIGS. 1 and 16, in the present embodiment, the two rows of the terminals 50 are attached to the movable housing 30 from below. In detail, the two rows of the second held portions 56 of the terminals 50 are press-fit into and held by opposite sides of the coupling portion 364 in the X-direction, respectively. The two rows of the contact portions 58 of the thus-held terminals 50 are arranged on opposite sides of the arrangement portion 324A in the X-direction, respectively, and the contact portions 58 of each row are arranged in the Y-direction. The movable housing 30 is inserted into the accommodation portion 28 of the fixed housing 20 from below together with the thus-arranged terminals 50. During this insertion, the two rows of the first held portions 52 of the terminals 50 are press-fit into and held by the two sidewalls 22 of the fixed housing 20, respectively. When this insertion is complete, the fixed portion 51 of each of the terminals 50 extends outward in the X-direction beyond a lower end of the fixed housing 20. Referring to FIG. 3, when the connector 10 is used, the fixed portion 51 of each of the terminals 50 is fixed on and connected to a conductive pad (not shown) of the circuit board 80 via soldering, etc.

Figure 5:
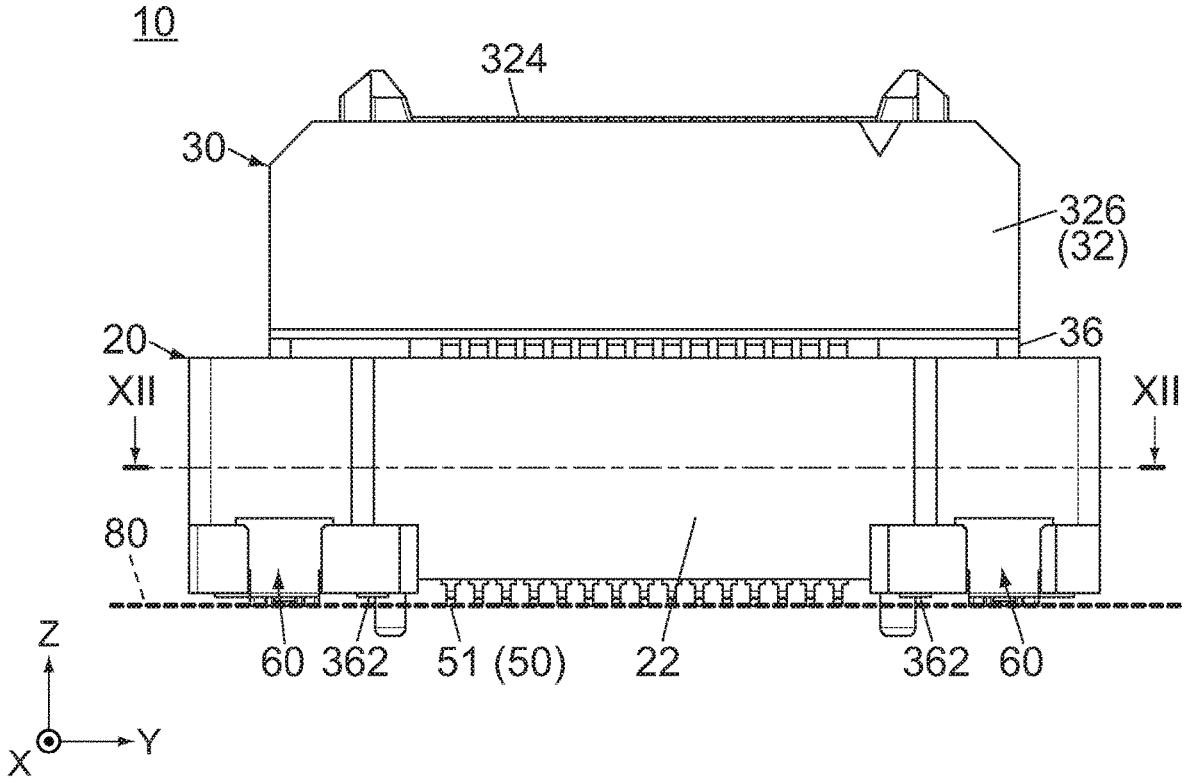
FIG. 5 is a side view showing the connector of FIG. 1, wherein a part of the circuit board is illustrated with dashed line.
Figure 9:
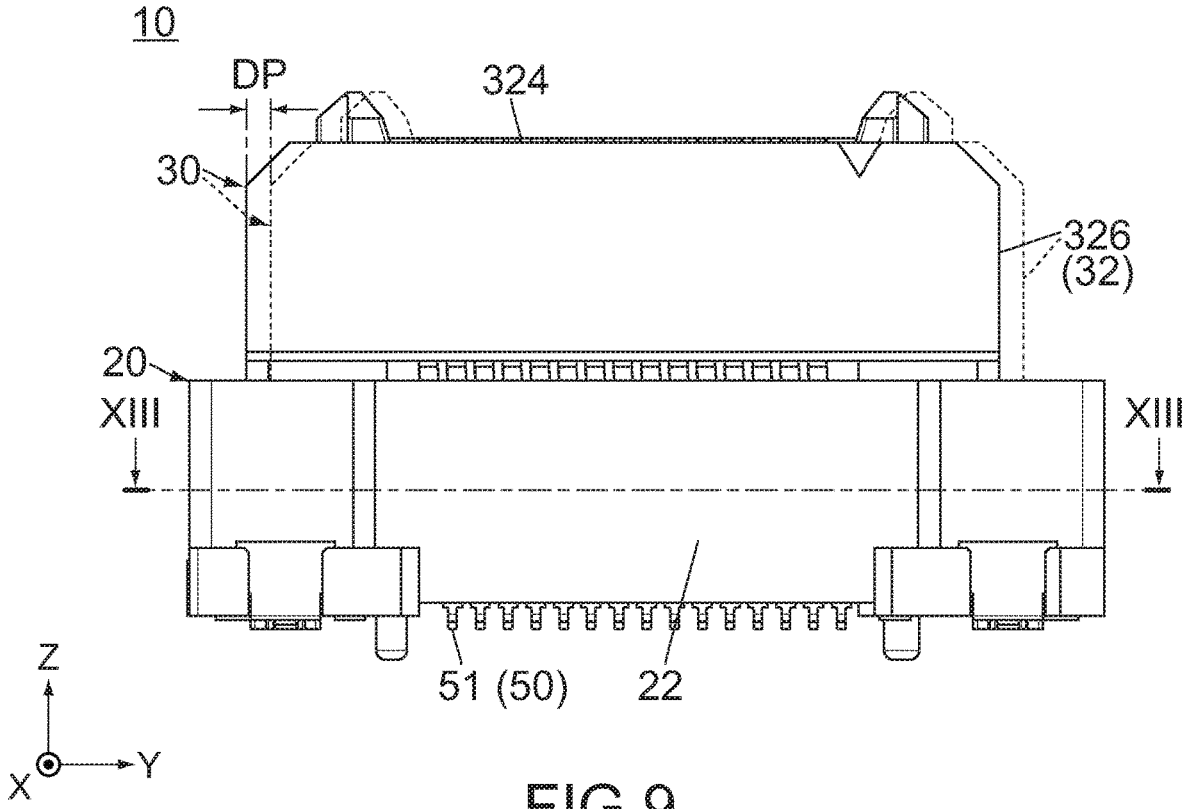
FIG. 9 is another side view showing the connector of FIG. 7, wherein a part of an outline of the movable housing at the position shown in FIG. 6 is illustrated with dashed line.

Referring to FIGS. 5 and 9, in the connector 10 which is assembled as described above, the movable housing 30 is supported to be movable by the terminals 50 which are fixed to the fixed housing 20 so as to be deformable. Moreover, the fit portion 32 is located above the fixed housing 20, and the base portion 36 is partially located in the fixed housing 20.

Figure 6:
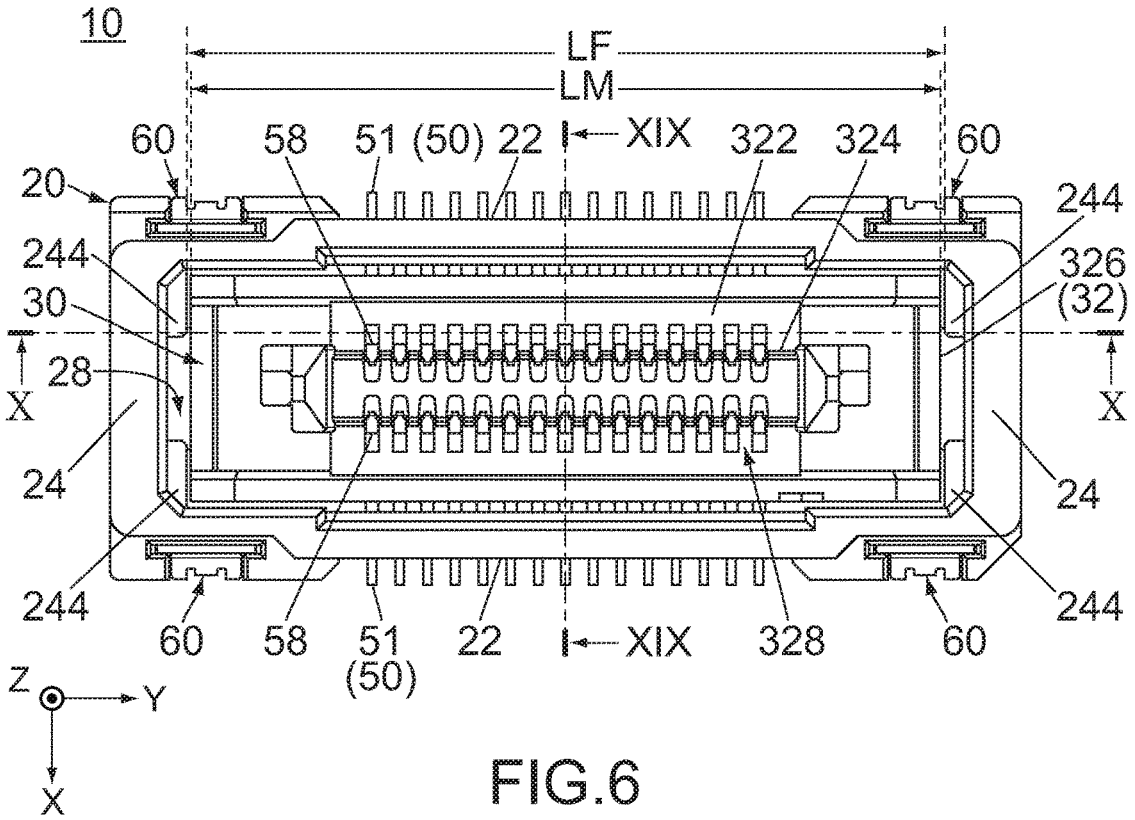
FIG. 6 is a top view showing the connector of FIG. 1.
Figure 14:
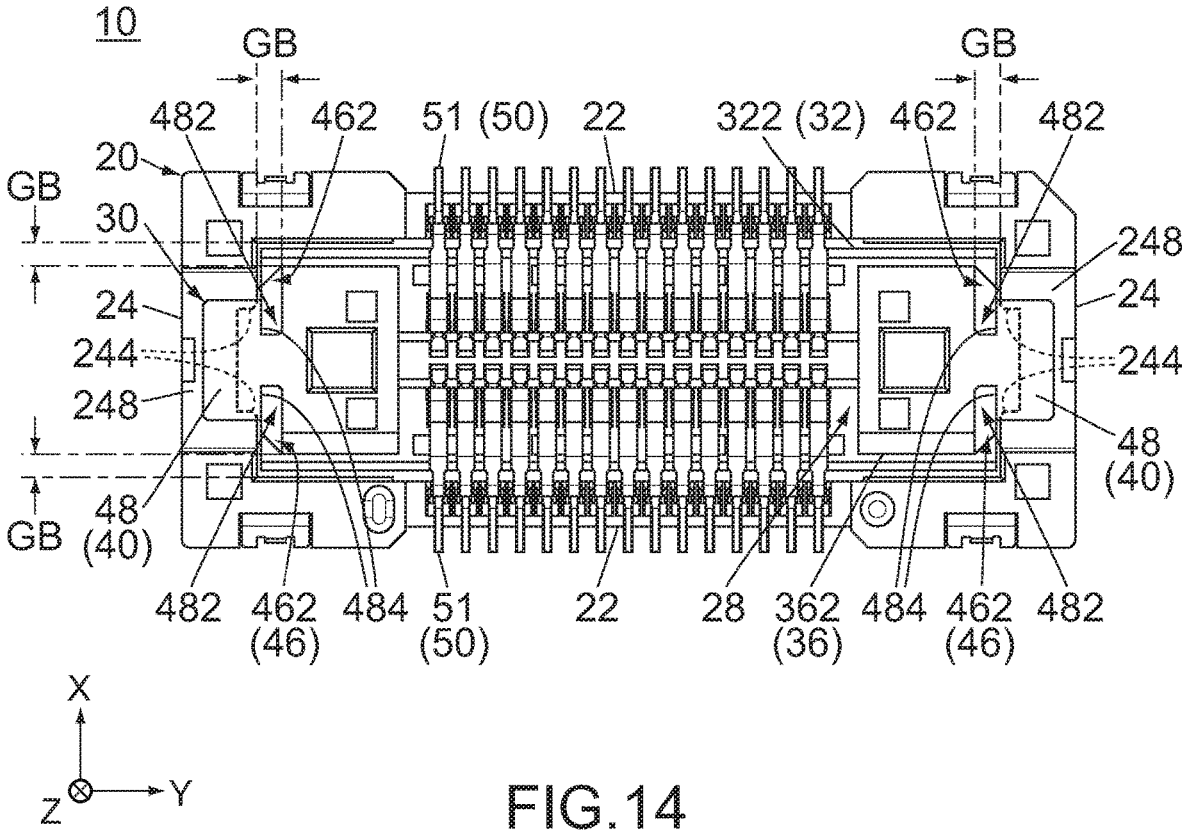
FIG. 14 is a bottom view showing the connector of FIG. 6, wherein outlines of parts of the end walls of the fixed housing, which are hidden behind the stopped portions of the movable housing, are illustrated with dashed line.

Referring to FIGS. 5 and 6, the movable housing 30 is located at an initial position, which is shown in FIGS. 5 and 6, under a state where no force except the force due to its own weight is applied thereto. Referring to FIG. 14, when the movable housing 30 is located at the initial position, which is shown in FIG. 14, the base portion 36 is partially accommodated in the accommodation portion 28 of the fixed housing 20 with a gap formed between the base portion 36 and each of the sidewalls 22 of the fixed housing 20 and a gap formed between the base portion 36 and each of the end walls 24 of the fixed housing 20, each of the gaps being shown with the reference sign GB in FIG. 14. The thus-arranged movable housing 30 is movable relative to the fixed housing 20 along the Z-direction and is movable relative to the fixed housing 20 along the XY-plane.

Figure 7:
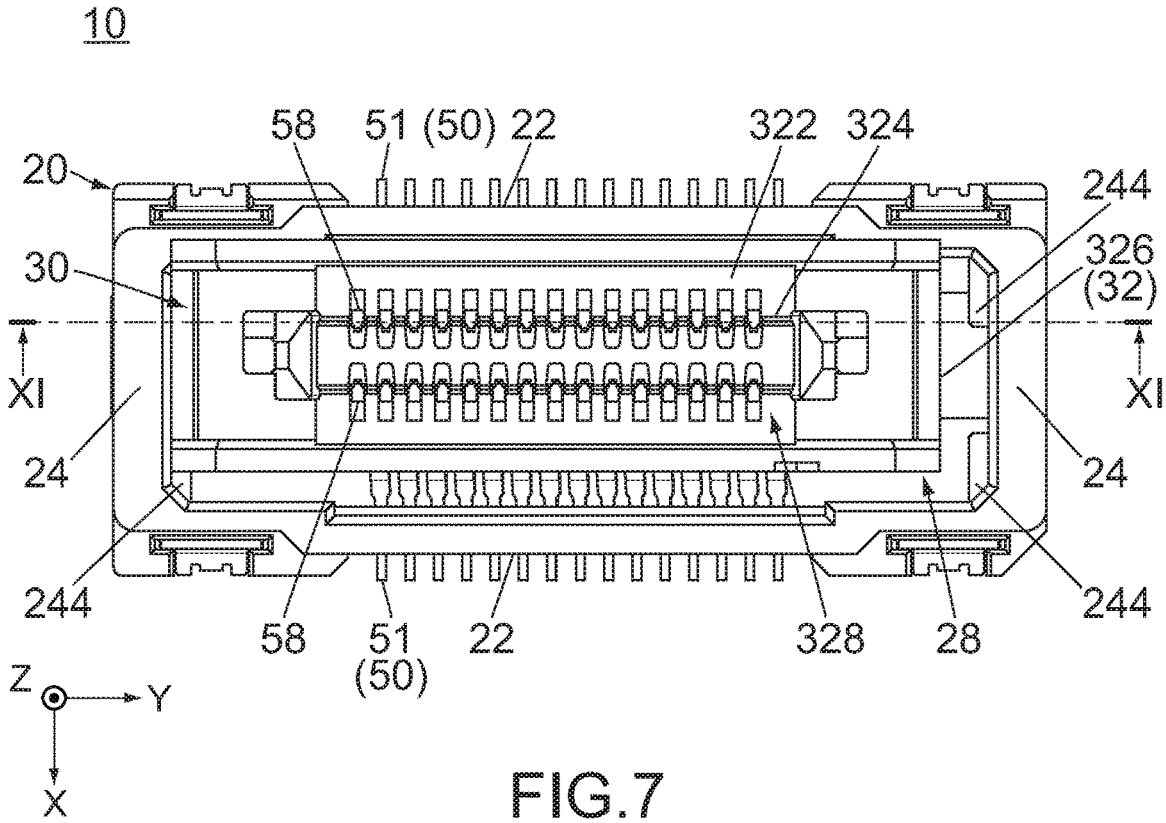
FIG. 7 is a top view showing the connector of FIG. 6, wherein a movable housing of the connector is moved relative to a fixed housing of the connector from the position shown in FIG. 6.
Figure 8:
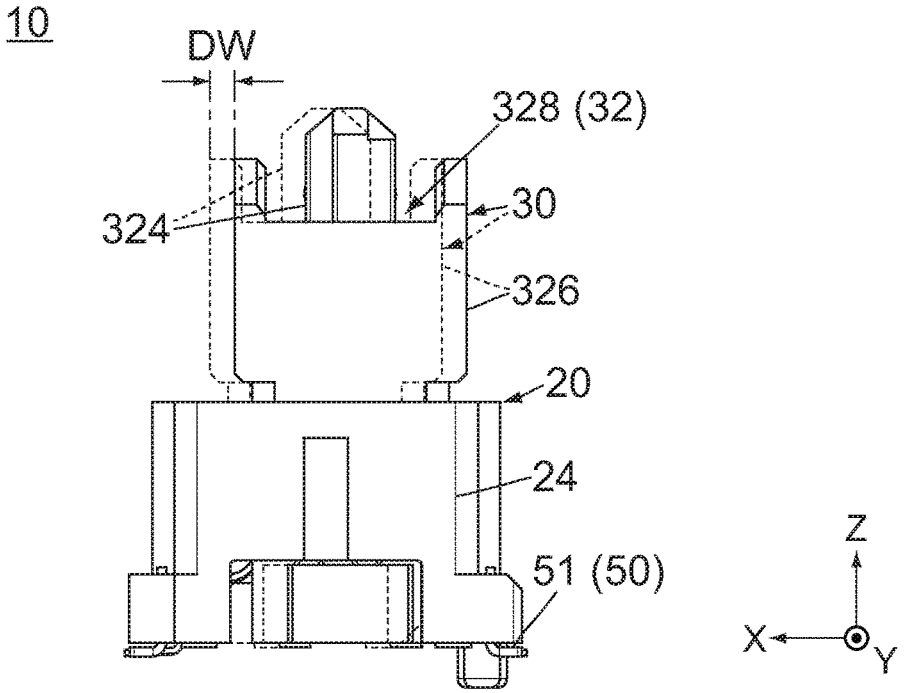
FIG. 8 is a side view showing the connector of FIG. 7, wherein a part of an outline of the movable housing at the position shown in FIG. 6 is illustrated with dashed line.

In detail, referring to FIGS. 4 and 6 to 8, the movable housing 30 is movable in opposite directions along the X-direction by a predetermined distance DW when located at the initial position, which is shown in FIGS. 4 and 6 and illustrated with dashed line in FIG. 8. Referring to FIGS. 5 to 7 and 9, the movable housing 30 is movable in opposite directions along the Y-direction by another predetermined distance DP when located at the initial position, which is shown in FIGS. 5 and 6 and illustrated with dashed line in FIG. 9. In addition, the movable housing 30 is slightly movable upward and is slightly movable downward when located at the initial position. As can be seen from the position of the lower end of the columnar portion 362 in FIG. 5, the movable housing 30 of the present embodiment is hard to be vertically moved when the connector 10 is mounted on the circuit board 80 (see FIG. 5). However, the movable housing 30 may be widely movable upward and downward.

Referring to FIG. 1, as described above, the connector 10 is a floating connector comprising the movable housing 30 which is movable relative to the fixed housing 20. The movable housing 30 of the present embodiment partially holds each of the terminals 50. The base portion 36 is partially accommodated in the accommodation portion 28 while the fit portion 32 is not accommodated in the accommodation portion 28. However, the present invention is not limited thereto. For example, the movable housing 30 may be supported by the terminals 50 without holding the terminals 50. The base portion 36 may be entirely accommodated in the accommodation portion 28. Thus, the base portion 36 may be, at least in part, accommodated in the accommodation portion 28.

Referring to FIGS. 10 to 15, the connector 10 has a movement regulation mechanism which regulates the movement of the movable housing 30 relative to the fixed housing 20. In the present embodiment, the regulated portions 40 of the movable housing 30 work as the movement regulation mechanism together with the projecting portions 244 and the stopping portions 248 provided on the end walls 24 of the fixed housing 20. Hereafter, explanation will be made about this movement regulation mechanism.

Figure 10:
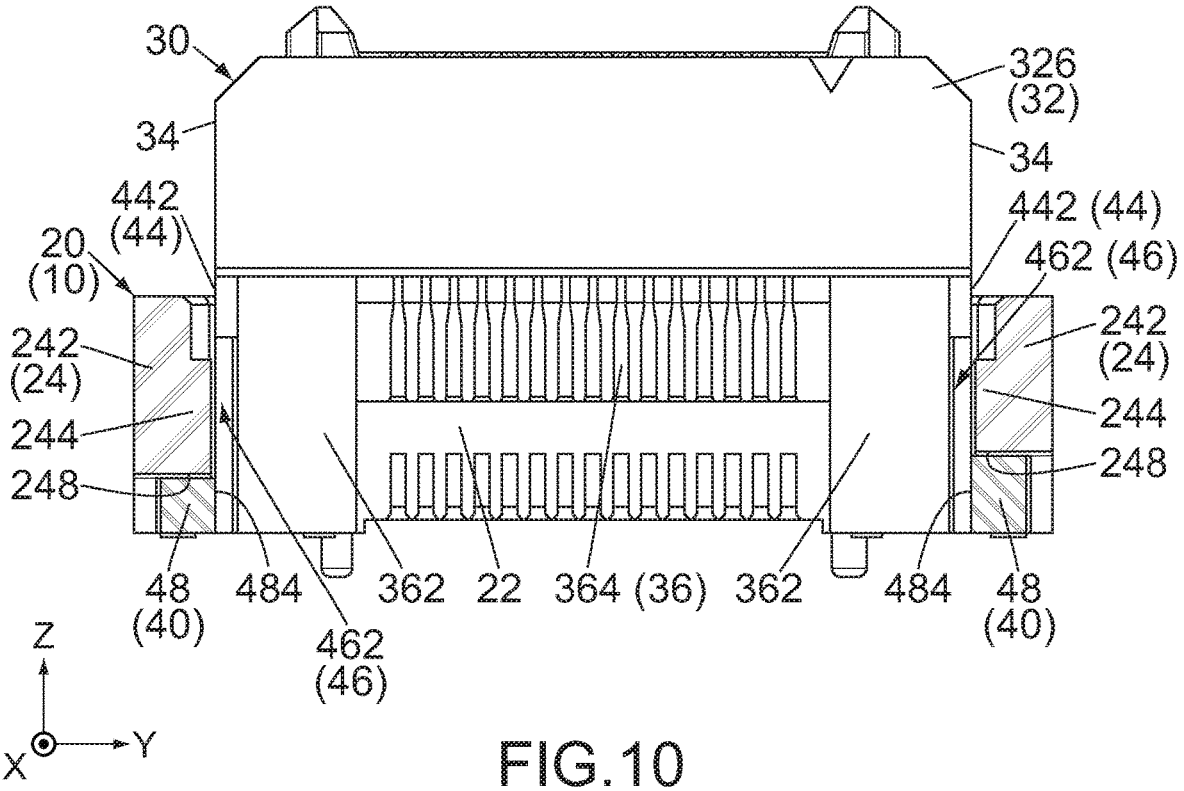
FIG. 10 is a partially cross-sectional view showing the connector of FIG. 6, wherein end walls of the fixed housing and stopped portions of the movable housing are cut off along line X-X.
Figure 11:
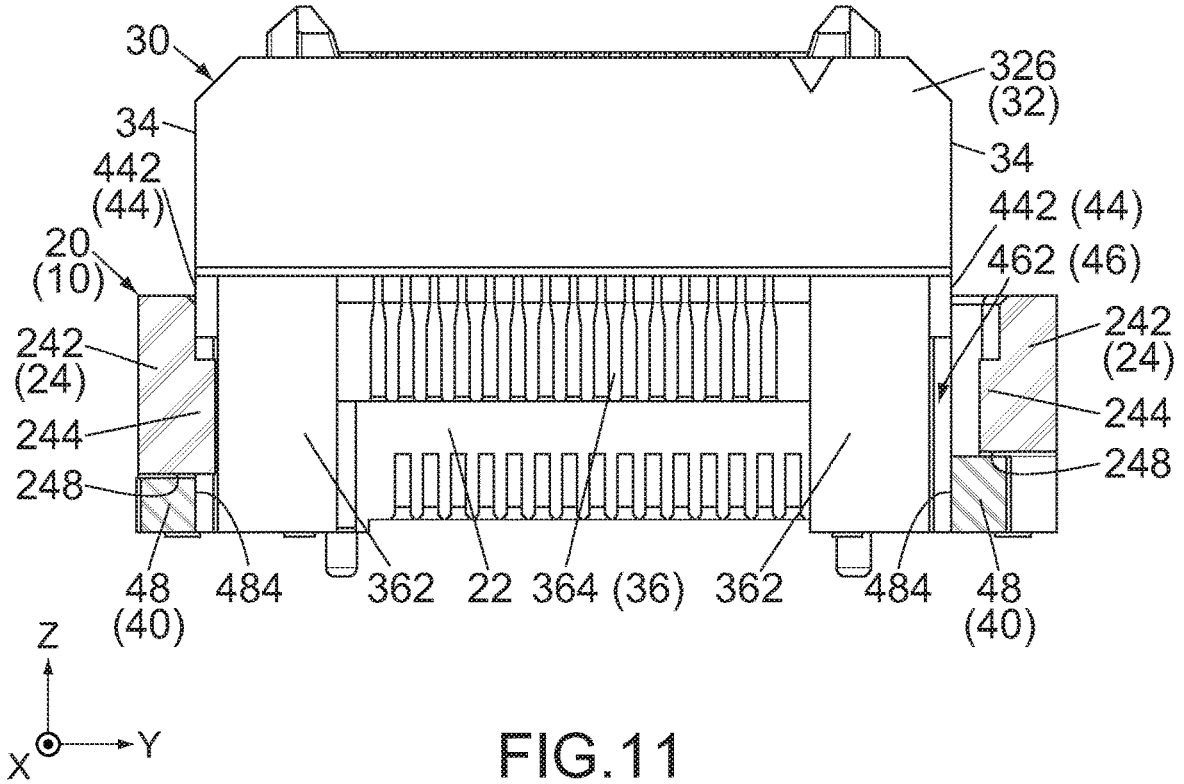
FIG. 11 is a partially cross-sectional view showing the connector of FIG. 7, wherein the end walls of the fixed housing and the stopped portions of the movable housing are cut off along line XI-XI.

Referring to FIGS. 10 and 11, as previously described, each of the regulated portions 40 of the movable housing 30 is provided with the reference surface 484, the receiving recess 46 and the stopped portion 48. Each of the regulated portions 40 is an end part of the base portion 36 in the Y-direction. In each of the thus-located regulated portions 40, the reference surface 484 is located at a position that is outermost in the Y-direction except the stopped portion 48. Each of the receiving recesses 46 is recessed inward in the Y-direction beyond the reference surface 484. Each of the projecting portions 244 is located between an upper end and a lower end of the corresponding receiving recess 46 in the Z-direction.

Figure 12:
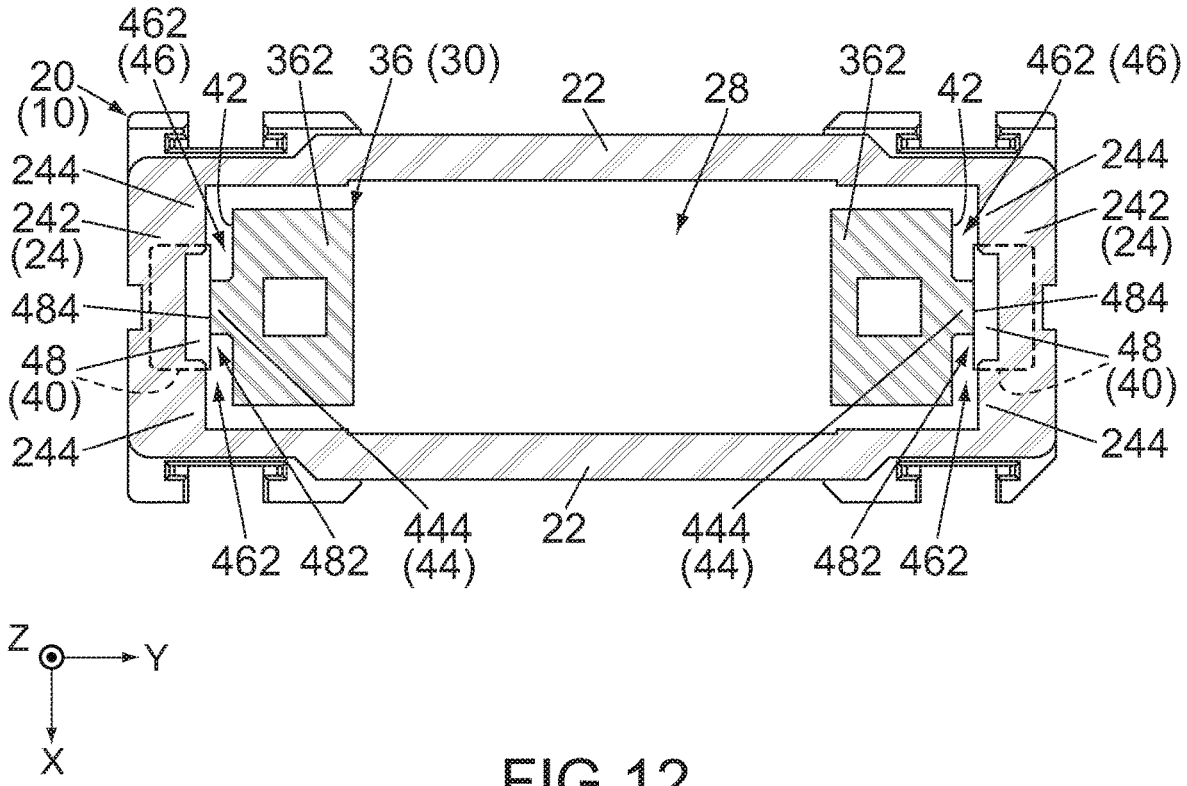
FIG. 12 is a cross-sectional view showing the fixed housing and the movable housing of the connector of FIG. 5, taken along line XII-XII, wherein outlines of parts of the stopped portions of the movable housing, which are hidden behind the end walls of the fixed housing, are illustrated with dashed line.
Figure 13:
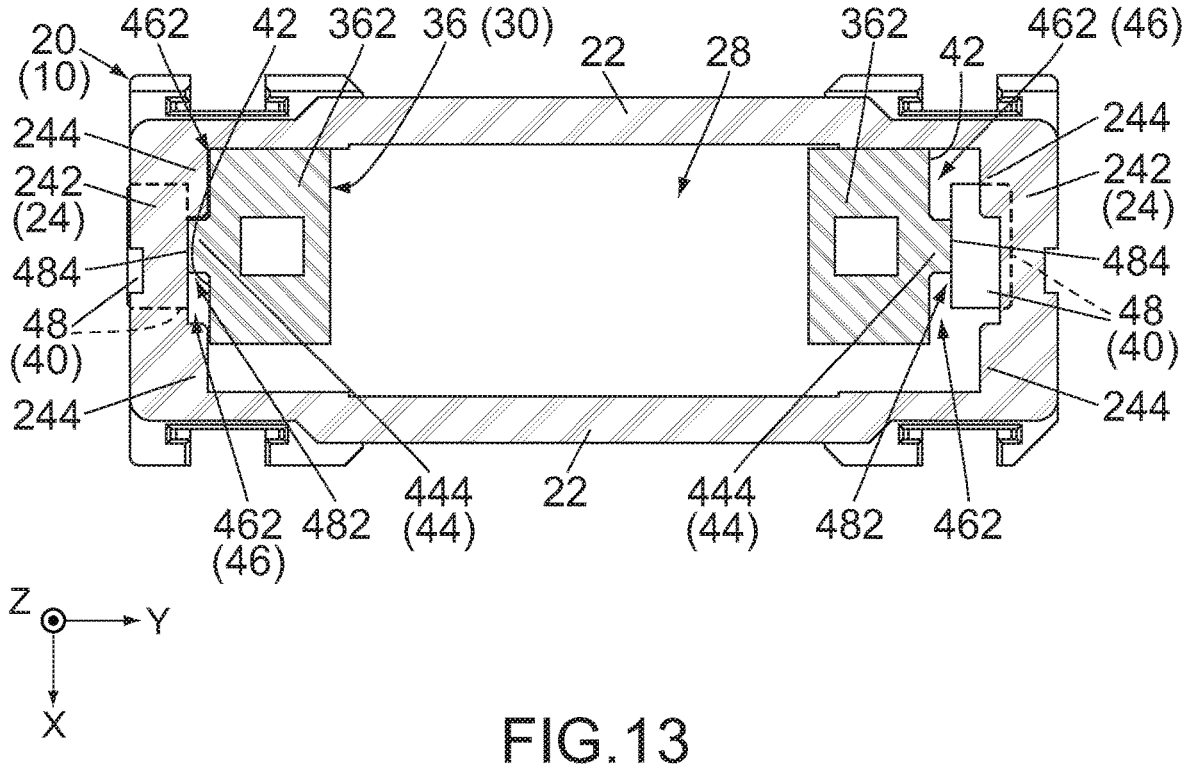
FIG. 13 is a cross-sectional view showing the fixed housing and the movable housing of the connector of FIG. 9, taken along line XIII-XIII, wherein outlines of parts of the stopped portions of the movable housing, which are hidden behind the end walls of the fixed housing, are illustrated with dashed line.

Referring to FIGS. 12 and 13, the size of each of the receiving recesses 46 in the XY-plane is equal to the size of the corresponding projecting portions 244 in the XY-plane. In detail, the size of each of the recesses 462 of the receiving recess 46 in the X-direction is equal to the size of the corresponding projecting portion 244 in the X-direction, and the size of each of the recesses 462 in the Y-direction is equal to the size of the corresponding projecting portion 244 in the Y-direction.

Each of the receiving recesses 46 formed as described above faces, at least in part, the corresponding projecting portions 244 in the Y-direction or receives, at least in part, the corresponding projecting portions 244. In detail, each of the receiving recesses 46 has the inner wall surface in the Y-direction as previously described, and each of the projecting portions 244 has an inner surface in the Y-direction. The boundary surface 42, or the inner wall surface of each of the receiving recesses 46 faces, at least in part, or is in contact with the inner surfaces of the corresponding projecting portions 244 in the Y-direction.

According to the present embodiment, when the movable housing 30 is located at the initial position, which is shown in FIG. 12, each of the recesses 462 partially faces the corresponding projecting portion 244 in the Y-direction. When the movable housing 30 is moved from the initial position to the position shown in FIG. 13, each of the recesses 462 of one of the regulated portions 40, or each of the recesses 462 of the positive Y-side regulated portion 40 in FIG. 13, faces, at least in part, the corresponding projecting portion 244 in the Y-direction, and each of the recesses 462 of a remaining one of the regulated portions 40, or each of the recesses 462 of the negative Y-side regulated portion 40 in FIG. 13, receives, at least in part, the corresponding projecting portion 244. However, the present invention is not limited thereto. For example, when the movable housing 30 is located at the initial position, each of the recesses 462 may partially receive the corresponding projecting portion 244.

As described above, according to the present embodiment, each of the receiving recesses 46 is able to receive the corresponding projecting portions 244 upon the movement of the movable housing 30 in the Y-direction. Referring to FIGS. 6, 9 and 14, according to this structure, a distance dimension LF between the two end walls 24 in the Y-direction, particularly between inner ends of the projecting portions 244 in the Y-direction, can be made almost as small as the size of the fit portion 32 in the Y-direction, or the distance dimension LM, without reducing a movable range of the movable housing 30 in the Y-direction (see the predetermined distance DP in FIG. 9). In other words, the size of the fixed housing 20 in the Y-direction can be made small while the movable housing 30 has a sufficient movable range in the Y-direction.

Figure 15:
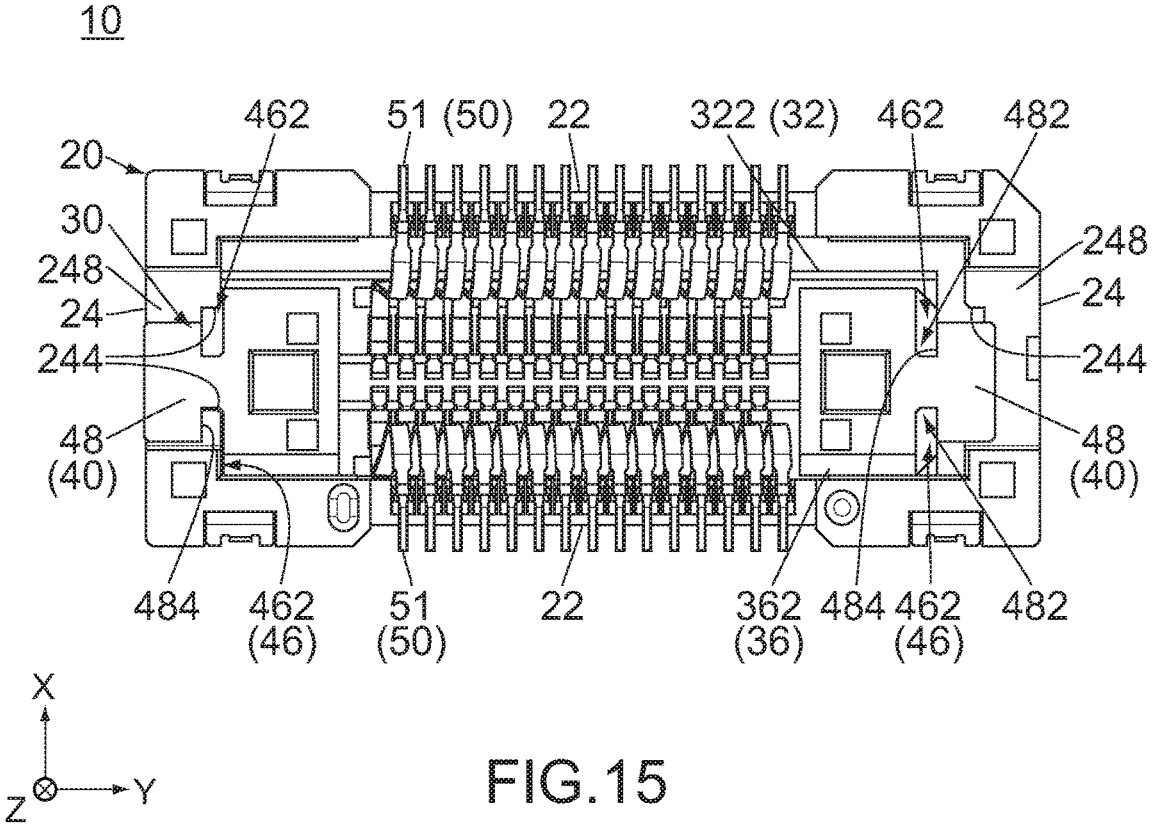
FIG. 15 is a bottom view showing the connector of FIG. 7.

Referring to FIGS. 10, 11, 14 and 15, each of the stopped portions 48 projects outward beyond the reference surface 484 in the Y-direction. Each of the stopped portions 48 is located below the corresponding stopping portion 248 both under a state where the movable housing 30 is located at the initial position, which is shown in FIGS. 10 and 14, and under another state where the movable housing 30 is moved from the initial position as shown in FIGS. 11 and 15, so that an upward movement thereof is regulated by the corresponding stopping portion 248. In detail, each of the stopped portions 48 is partially located just under the corresponding stopping portion 248. The upward movement of the movable housing 30 can be regulated by the stopping portions 248 and the stopped portions 48 which are arranged as described above, so that the movable housing 30 is prevented from coming off above the fixed housing 20.

Referring to FIGS. 12 to 15, according to the present embodiment, most of the lower surfaces of the end walls 24 including the lower surfaces of the projecting portions 244 work as the stopping portions 248. This structure enables each of the stopped portions 48 to be reduced in size in the Y-direction while each of the stopped portions 48 sufficiently projects outward in the Y-direction relative to the boundary surface 42, or relative to the inside wall surface of the receiving recess 46 in the Y-direction. Thus, the size of the entire movable housing 30 including the stopped portions 48 can be reduced in the Y-direction. As a result, the connector 10 can be reduced in size in the Y-direction while the movable housing 30 is prevented from coming off above the fixed housing 20.

As described above, according to the present invention, the connector 10 can be reduced in size in the Y-direction as a whole. Meanwhile, the movable housing 30 has a sufficient movable range in the Y-direction, and the movable housing 30 is prevented from coming off above the fixed housing 20. Thus, the present invention provides a floating connector with a structure which enables the floating connector to be reduced in size in the Y-direction.

Referring to FIGS. 12 to 15, according to the present embodiment, in each of the regulated portions 40, the stopped portion 48 is located between opposite ends of the receiving recess 46 in the X-direction. In detail, one of opposite ends of each of the stopped portions 48 in the X-direction is located at the middle of one of the two recesses 462 in the X-direction, and a remaining one of the opposite ends of each of the stopped portions 48 in the X-direction is located at the middle of a remaining one of the two recesses 462 in the X-direction. In other words, the stopped portion 48 and the receiving recess 46 of each of the regulated portions 40 are located at positions partially same as each other in the X-direction.

When the movable housing 30 is located at the initial position, which is shown in FIGS. 12 and 14, each of the stopped portions 48 provided as described above does not project beyond the corresponding end wall 24 and is reliably located below the corresponding stopping portion 248. Even when the movable housing 30 is moved in the Y-direction (see FIGS. 13 and 15), each of the stopped portions 48 hardly projects beyond the corresponding end wall 24 and is reliably located below the corresponding stopping portion 248. However, the present invention is not limited thereto. For example, the position in the X-direction and the size in the Y-direction of each of the stopped portions 48 can be modified as necessary.

Referring to FIGS. 10 and 11, according to the present embodiment, the size of each of the protruding portions 44 in the Y-direction is equal to the size of each of the projecting portions 244 in the Y-direction. Each of the upper protruding portions 442 is located above the corresponding projecting portions 244. Referring to FIGS. 12 and 13, each of the middle protruding portions 444 is located between the corresponding two projecting portions 244 in the X-direction regardless of the position of the movable housing 30. The thus-arranged protruding portions 44 allow the movable housing 30 to be moved in the XY-plane.

Referring to FIGS. 16 and 23, according to the present embodiment, the two end surfaces 34 of the fit portion 32 correspond to the reference surfaces 484 of the base portion 36, respectively. Each of the reference surfaces 484 is located at a position same as that of the corresponding end surface 34 in the Y-direction. If each of the reference surfaces 484 is located inward of the corresponding end surface 34 in the Y-direction, the size of each of the stopped portions 48 in the Y-direction needs to be made large. According to this structure, one of the stopped portions 48 might project beyond the corresponding end wall 24 of the fixed housing 20 upon the movement of the movable housing 30. In contrast, according to the present embodiment, the size of the base portion 36 excluding the stopped portions 48 in the Y-direction is designed to be almost equal to the distance dimension LM of the fit portion 32, so that the size of each of the stopped portions 48 in the Y-direction can be made small. However, the present invention is not limited thereto. For example, a positional relation between the end surface 34 and the reference surface 484 can be modified as necessary.

Referring to FIGS. 16 and 20, the movable housing 30 of the present embodiment is a molded product made of resin. Referring to FIGS. 21 and 22, all of the parts of the movable housing 30 are visible when the movable housing 30 is seen from above or from below along the Z-direction. For example, when the movable housing 30 is seen from above along the Z-direction, each of the receiving recesses 46 is hidden behind the fit portion 32 (see FIG. 21). When each of the regulated portions 40 is seen along the Y-direction, the communication portions 482 are hidden behind the stopped portion 48 (see FIG. 24). However, when each of the regulated portions 40 is seen from below along the Z-direction, the receiving recess 46 is visible through the communication portions 482 (see FIG. 22). In detail, a part of the receiving recess 46 which is located at a position same as that of one of the communication portions 482 in the X-direction is visible through the communication portions 482, and another part of the receiving recess 46 which is located outward of the communication portions 482 in the X-direction is visible without being seen through the communication portions 482.

Referring to FIGS. 16 and 20, as can be seen from the aforementioned structure, the movable housing 30 of the present embodiment can be formed by using only two metal dies one of which is an upper die (not shown) for mainly forming the fit portion 32 and a remaining one of which is a lower die (not shown) for mainly forming the base portion 36. For example, each of the receiving recesses 46 can be formed by the lower die. Moreover, each of the communication portions 482 is a trace through which a part of the lower die is removed. As described above, the movable housing 30 of the present embodiment can be formed without using a slide core which is moved along the XY-plane. According to the present embodiment, the connector 10 can be reduced in size in the Y-direction while increase of manufacturing cost and decrease of molding speed due to use of the slide core are prevented.

According to the present embodiment, each of the regulated portions 40 is formed with the protruding portion 44 and the communication portions 482. As a result, each of the receiving recesses 46 is separated into the two recesses 462. Referring to FIG. 12, each of the end walls 24 of the fixed housing 20 has the two separated projecting portions 244 which correspond to the two recesses 462, respectively. However, the present invention is not limited thereto. For example, referring to FIG. 20, each of the regulated portions 40 may be provided with none of the protruding portion 44 and the communication portions 482. According to this structure, each of the receiving recesses 46 is a single continuous recess, and the number of the projecting portion 244 of each of the end walls 24 is one. Moreover, each of the stopped portions 48 projects outward in the Y-direction from the boundary surface 42 while no gap is formed between the boundary surface 42 and the stopped portion 48.

The aforementioned structure also enables the connector 10 to be reduced in size in the Y-direction similarly to the present embodiment. However, according to this structure, a slide core is necessary to form the movable housing 30. Therefore, the present embodiment is preferable from a view point of prevention of increase of manufacturing cost and decrease of molding speed.

Referring to FIG. 23, each of the receiving recesses 46 of the present embodiment is entirely located below the fit portion 32. According to the present embodiment, the fit portion 32 can be shaped in a desired shape with no limitation due to the receiving recesses 46. However, the present invention is not limited thereto. For example, each of the receiving recesses 46 may extend to the fit portion 32. In other words, none of the upper protruding portions 442 may be formed.

Referring to FIG. 24, according to the present embodiment, the maximum size WB of the base portion 36 in the X-direction is smaller than the maximum size WM of the fit portion 32 in the X-direction. Referring to FIGS. 6 to 8, according to this structure, the fixed housing 20 can be reduced in size in the X-direction while the movable housing 30 has a sufficient movable range in the X-direction. However, the relation between the maximum size WB of the base portion 36 (see FIG. 24) and the maximum size WM of the fit portion 32 (see FIG. 24) can be modified as necessary.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mateable with a mating connector which comprises a mating fit portion, wherein:

the connector comprises a fixed housing, a movable housing and a plurality of terminals;

the terminals are held by the fixed housing and are arranged in a pitch direction;

the fixed housing has two sidewalls, two end walls and an accommodation portion;

each of the sidewalls extends along the pitch direction;

each of the end walls couples the sidewalls with each other in a width direction perpendicular to the pitch direction;

the accommodation portion is a space which is enclosed by the sidewalls and the end walls in a horizontal plane defined by the pitch direction and the width direction;

each of the end walls has a stopping portion and a projecting portion;

each of the stopping portions faces downward in an upper-lower direction perpendicular to both the pitch direction and the width direction;

each of the projecting portions projects inward in the pitch direction;

the movable housing is movable relative to the fixed housing along the upper-lower direction and is movable relative to the fixed housing along the horizontal plane;

the movable housing has a fit portion and a base portion;

the fit portion is fit to the mating fit portion under a mated state where the connector and the mating connector are mated with each other;

the base portion is located below the fit portion and is, at least in part, accommodated in the accommodation portion;

the base portion has two regulated portions which correspond to the end walls, respectively;

the regulated portions are located at opposite ends of the base portion in the pitch direction, respectively;

each of the regulated portions has a reference surface, a stopped portion and a receiving recess;

in each of the regulated portions, the reference surface is located at a position that is outermost in the pitch direction except the stopped portion, and the reference surface is in parallel to a plane defined by the width direction and the upper-lower direction;

each of the stopped portions projects outward in the pitch direction beyond the reference surface and is located below a corresponding one of the stopping portions, and an upward movement thereof is regulated by the corresponding one of the stopping portions;

each of the receiving recesses is recessed inward in the pitch direction beyond the reference surface; and each of the receiving recesses faces, at least in part, a corresponding one of the projecting portions in the pitch direction or receives, at least in part, the corresponding one of the projecting portions.

2. The connector as recited in claim 1, wherein:

the fit portion has two end surfaces which correspond to the reference surfaces, respectively;

the end surfaces are located at opposite ends of the fit portion in the pitch direction, respectively; and each of the reference surfaces is located at a position same as that of a corresponding one of the end surfaces in the pitch direction.

3. The connector as recited in claim 1, wherein:

each of the receiving recesses includes two recesses arranged in the width direction; and in each of the regulated portions, the stopped portion is located below the receiving recess and is located between opposite ends of the receiving recess in the width direction.

4. The connector as recited in claim 1, wherein the stopped portion and the receiving recess of each of the regulated portions are located at positions partially same as each other in the width direction.

5. The connector as recited in claim 1, wherein:

each of the regulated portions is formed with a communication portion;

each of the communication portions is located inward of the stopped portion in the pitch direction and extends between a lower end of the stopped portion and the receiving recess in the upper-lower direction;

when each of the regulated portions is seen from below along the upper-lower direction, the receiving recess is visible through the communication portion; and when each of the regulated portions is seen along the pitch direction, the communication portion is hidden behind the stopped portion.

6. The connector as recited in claim 1, wherein when the movable housing is seen from above along the upper-lower direction, each of the receiving recesses is hidden behind the fit portion.

7. The connector as recited in claim 1, wherein each of the receiving recesses is entirely located below the fit portion.

8. The connector as recited in claim 1, wherein the maximum size of the base portion in the width direction is smaller than the maximum size of the fit portion in the width direction.

* * * * *